US011643118B2

(12) United States Patent
Sandheinrich et al.

(10) Patent No.: US 11,643,118 B2
(45) Date of Patent: May 9, 2023

(54) RAILCAR FOR TRANSPORT OF STEEL COILS WITH REMOVABLE BI-LEVEL ROOF

(71) Applicant: Gunderson LLC, Portland, OR (US)

(72) Inventors: Glenn A. Sandheinrich, Weldon Spring, MO (US); Justin Dobsch, St. Charles, MO (US)

(73) Assignee: Gunderson LLC, Portland, OR (US)

( * ) Notice: Subject to any disclaimer, the term of this patent is extended or adjusted under 35 U.S.C. 154(b) by 462 days.

(21) Appl. No.: 16/846,570

(22) Filed: Apr. 13, 2020

(65) Prior Publication Data

US 2020/0331505 A1 Oct. 22, 2020

Related U.S. Application Data

(60) Provisional application No. 62/905,088, filed on Sep. 24, 2019, provisional application No. 62/836,024, filed on Apr. 18, 2019.

(51) Int. Cl.
*B61D 3/16* (2006.01)
*B61D 45/00* (2006.01)

(52) U.S. Cl.
CPC ..... *B61D 3/16* (2013.01); *B61D 45/00* (2013.01)

(58) Field of Classification Search
CPC ..... B61D 3/16; B61D 45/00; B61D 45/0003; B60P 7/0892; B60P 7/12; B60P 3/035
USPC ..... 105/404; 410/36, 42, 47, 49
See application file for complete search history.

(56) References Cited

U.S. PATENT DOCUMENTS

| | | | | |
|---|---|---|---|---|
| 276,017 A | | 4/1883 | Foster | |
| 2,620,748 A | | 12/1952 | Shields | |
| 2,810,602 A | | 10/1957 | Abrams | |
| 2,977,900 A | * | 4/1961 | Farrar | B61D 39/00 220/678 |
| 3,091,348 A | | 5/1963 | Neuhauser | |
| 3,197,236 A | * | 7/1965 | Burton | B60P 7/12 410/49 |
| 3,392,682 A | * | 7/1968 | Francis | B61D 45/003 105/422 |

(Continued)

FOREIGN PATENT DOCUMENTS

| | | | | |
|---|---|---|---|---|
| CA | 2328672 A1 | * | 6/2002 | B61D 3/16 |
| CN | 201890231 U | | 7/2011 | |

(Continued)

OTHER PUBLICATIONS

"CR 606306 Class G41 Photo", Conrail Historical Society, Inc., Conrail Photo Archive, photo of railcar located at Altoona, PA, Copyright Grant Lowry.

(Continued)

*Primary Examiner* — Hilary L Gutman
(74) *Attorney, Agent, or Firm* — Neal, Gerber & Eisenberg LLP

(57) ABSTRACT

A railcar for transporting one or more steel coils. In various embodiments, the railcar includes a front truck assembly, a rear truck assembly, a center sill assembly including a center sill operably supported by the front and rear truck assemblies, and first and second side walls supported by and substantially coupled to the center sill assembly such that the first and second side walls are spaced-apart from and substantially parallel to the longitudinal axis of the center sill.

24 Claims, 19 Drawing Sheets

(56) References Cited

U.S. PATENT DOCUMENTS

| | | | | |
|---|---|---|---|---|
| 3,408,958 | A * | 11/1968 | Van De Plasch | B61D 39/008 105/377.08 |
| 3,581,674 | A | 6/1971 | O'Leary | |
| 3,693,554 | A | 9/1972 | O'Leary et al. | |
| 3,715,993 | A | 2/1973 | Orlik | |
| 4,102,274 | A | 7/1978 | Feary et al. | |
| 4,930,426 | A | 6/1990 | Saxton et al. | |
| 5,054,403 | A | 10/1991 | Hill et al. | |
| 5,170,717 | A * | 12/1992 | Richmond | B61D 45/003 105/418 |
| 5,170,718 | A | 12/1992 | Hill et al. | |
| 5,379,702 | A | 1/1995 | Saxton et al. | |
| 5,611,285 | A | 3/1997 | Saxton | |
| 6,077,005 | A | 6/2000 | Westlake | |
| 6,231,284 | B1 | 5/2001 | Kordel | |
| 6,363,864 | B1 | 4/2002 | Jamrozy et al. | |
| 6,439,132 | B1 | 8/2002 | Deaver | |
| 6,523,484 | B2 | 2/2003 | Saxton et al. | |
| 6,543,368 | B1 | 4/2003 | Forbes | |
| 6,679,187 | B2 | 1/2004 | Dorian et al. | |
| 6,739,268 | B2 | 5/2004 | Al-kaabi et al. | |
| 6,769,366 | B1 | 8/2004 | Lydic et al. | |
| 6,846,139 | B2 | 1/2005 | Al-kaabi et al. | |
| 6,923,608 | B2 | 8/2005 | Rediehs | |
| 7,077,269 | B2 * | 7/2006 | Kissell | B65D 61/00 211/72 |
| 7,234,904 | B2 | 6/2007 | Al-kaabi et al. | |
| 7,757,610 | B2 | 7/2010 | Saxton et al. | |
| 8,011,865 | B2 | 9/2011 | Anderson | |
| 8,033,768 | B2 | 10/2011 | Anderson | |
| 8,177,461 | B2 | 5/2012 | Schutz et al. | |
| 8,277,155 | B2 | 10/2012 | Anderson | |
| 8,308,409 | B2 | 11/2012 | Anderson | |
| 8,342,105 | B2 | 1/2013 | Selapack et al. | |
| 8,366,361 | B1 * | 2/2013 | Landrum | B61D 3/16 410/47 |
| 8,388,285 | B2 | 3/2013 | Langh | |
| 9,096,237 | B2 | 8/2015 | Kutschera | |
| 9,096,238 | B2 | 8/2015 | Josephson et al. | |
| 9,387,864 | B2 | 7/2016 | Lydic et al. | |
| 9,862,393 | B2 | 1/2018 | Josephson et al. | |
| 10,017,191 | B2 | 7/2018 | Single | |
| 10,300,931 | B2 | 5/2019 | Boring et al. | |
| 10,315,667 | B2 * | 6/2019 | Thompson | B61D 3/16 |
| 11,535,282 | B2 | 12/2022 | Latourrette | |
| 2003/0230214 | A1 | 12/2003 | Forbes | |
| 2014/0013995 | A1 * | 1/2014 | Kutschera | B61D 3/16 105/378 |
| 2014/0305332 | A1 | 10/2014 | Miller | |
| 2015/0083020 | A1 * | 3/2015 | Lydic | B61D 3/16 105/355 |
| 2015/0232106 | A1 | 8/2015 | Boring et al. | |
| 2017/0217450 | A1 * | 8/2017 | Thompson | B61D 45/003 |
| 2017/0240819 | A1 | 8/2017 | Snow et al. | |
| 2018/0086354 | A1 | 3/2018 | Kress et al. | |
| 2019/0135308 | A1 | 5/2019 | Single | |
| 2019/0256111 | A1 * | 8/2019 | Thompson | B61D 3/16 |
| 2020/0101987 | A1 | 4/2020 | Kress et al. | |
| 2021/0261172 | A1 * | 8/2021 | Gachhadar | B61D 45/003 |
| 2022/0250659 | A1 * | 8/2022 | Warwick | B61D 45/001 |

FOREIGN PATENT DOCUMENTS

| | | | | |
|---|---|---|---|---|
| FR | 2497162 | A * | 7/1982 | B60P 3/035 |
| RU | 111082 | U1 | 12/2011 | |
| UA | 8657 | U | 8/2005 | |

OTHER PUBLICATIONS

"CR 606306 Class G41 Photo", Conrail Historical Society, Inc., Conrail Photo Archive, photo of railcar located at Baden (East Conway), PA 1993/94, Copyright Grant Lowry 2016.

"CR 606306 Class G41 Photo", Conrail Historical Society, Inc., Conrail Photo Archive, photo of railcar located at Cove, PA 1987/88, Copyright Grant Lowry 2016.

"CR 606306 Class G41 Photo", Conrail Historical Society, Inc., Conrail Photo Archive, photo of railcar seen Jul. 1996.

"CR 606306 Class G41 Photo", Conrail Historical Society, Inc., Conrail Photo Archive, photo of railcar seen Jun. 1994, built Dec. 1965.

"CR 622585 Class G41 Photo", Conrail Historical Society, Inc., Conrail Photo Archive, photo of railcar seen at Enola, PA 1991/92, Copyright Grant Lowry 2016.

"CR 622849 Class G41 Photo", Conrail Historical Society, Inc., Conrail Photo Archive, photo of railcar Jul. 1996.

"CR 622849 Glass G41 Photo", Conrail Historical Society, Inc., Conrail Photo Archive, photo of railcar Apr. 1994.

"Shimmns S10B 4-Axle Coil Steel Product Wagon", Greenbrier Europe, available prior to May 7, 2019.

"Shmmnss 4 Axle Hot Coil Steel Product Wagon", Greenbrier Europe, available prior to May 7, 2019.

Assorted Known Existing Rail Cars, available before the priority date of this application.

* cited by examiner

RAILCAR FOR TRANSPORT OF STEEL COILS WITH REMOVABLE BI-LEVEL ROOF

PRIORITY CLAIM

This application claims priority to and the benefit of U.S. Provisional Patent Application No. 62/836,024, filed Apr. 18, 2019, and U.S. Provisional Patent Application No. 62/905,088, filed Sep. 24, 2019, the entire contents of both of which are incorporated herein by reference.

TECHNICAL FIELD

The present disclosure relates generally to railroad (railway) cars, or railcars (and related components) for transporting metal coils, and more particularly to a railcar capable of transporting metal coils supported in transverse troughs, which may be loaded hot, covered, and allowed to cool in the railcar.

BACKGROUND

Coil railcars (often called "coil cars") are a well-known type of gondola railcar configured for the transport of sheet metal coils (often called "steel coils"). The first use of coil cars dates back to at least as early as the mid-1960s when Pennsylvania Railroad built and deployed its "Class G41" cars illustrated in FIGS. 17 and 18. As can be seen in these figures, the body of the Class G41 coil railcars included a series of transverse troughs to support coils stacked on their sides. FIG. 19 illustrates a similar prior art transverse coil gondola-type railcar 10 with a body 12 having side walls (or sills)_and supported by trucks such as truck 14, wherein the body 12 includes transverse troughs such as trough 16 configured to support coils such as coil 18. FIG. 19 further illustrates that steel coils manufactured with differing coil diameters (e.g., relatively large, medium, and small coil diameters) can be transported by rail.

More recently, U.S. Pat. No. 9,387,864 disclosed a railcar for transporting steel coils in a plurality of transverse troughs formed by modular "trough forming assemblies." The railcar disclosed in the '864 patent (illustrated in FIGS. 20, 21, and 22) had (a) a center sill 22 supported on a pair of trucks (not shown) and connected to couplers such as coupler 24; (b) a pair of side walls 26 that form part of a body 28 coupled to the center sill 22 (each side wall including a plurality of panels such as panel 30, a plurality of vertically extending supports such as support 34, and a plurality of longitudinally extending rails such as rail 32), and a plurality of trough forming assemblies 40 (each including inner surfaces such as inner surface 44) and each including a bottom member 42, a center cross bearer member 46 coupled to the opposite side walls and the center sill, and a support 48; (c) a pair of angled floor plates 52 coupled to the side walls by end plates such as end plate 50 and that form the longitudinally fore and aft sections of adjacent troughs; (d) a plurality of end member such as end member 54 and 58; and (e) a plurality of floor plate supporting gussets 56 extending between the center cross bearer member and the floor plates such as floor plate 60. While this configuration allegedly provided improved modularity in the construction of these coil cars, this configuration introduced additional overall weight and separately created the potential for less desirable weight distribution over the entirety of the railcar.

Various prior art coil cars also included lids/covers that covered the coils after loading and during transport. Known covers were built to accommodate the largest anticipated coil diameter across the entire railcar. In addition to providing physical protection for the steel coils, these covers were also configured to extend the time needed for hot-loaded steel coils to cool to the temperature of an environment surrounding the railcar.

Thus, there is a need in the industry for a railcar for transporting steel coils having a static bunk configuration that minimizes the weight necessary to provide appropriate support to a substantial quantity of steel coils. There is an additional need for a railcar that provides improved weight distribution. There is also another need in the industry for a railcar that has an improved roof configuration for use with a railcar for transporting steel coils. These needs are variously met along with other advantages provided by disclosure of the present application.

BRIEF SUMMARY

The following presents a simplified summary of the present disclosure to provide a basic understanding of some aspects of the present disclosure. This summary is not an extensive overview of the present disclosure. It is not intended to identify key or critical elements of the present disclosure or to delineate the scope of the present disclosure. The following summary merely presents some concepts of the present disclosure in a simplified form as a prelude to the more detailed description provided below.

The present disclosure is directed, in part, to a railcar for transporting one or more steel coils. In various embodiments, the railcar includes a front truck assembly, a rear truck assembly, a center sill assembly including a center sill operably supported by the front and rear truck assemblies, and first and second side walls supported by and substantially coupled to the center sill assembly such that the first and second side walls are spaced-apart from and substantially parallel to the longitudinal axis of the center sill.

The railcar further includes a front, outer-coil holding assembly sitting over the center sill and extending to each of the first and second side walls. The front outer-coil holding assembly includes first and second front coil-receiving plates. Each of the first and second front coil-receiving plates has an inner face and an outer face. The inner and outer faces are bounded by a lower edge and at least two side edges. The lower edge of the first front coil-receiving plate is substantially coupled to one of the inner or outer faces of the second front coil-receiving plate. The lower edge of the second front coil-receiving plate is substantially coupled to the opposite of the inner or outer faces of the first front coil-receiving plate. The front outer-coil holding assembly has a front coil trough substantially transverse to the longitudinal axis of the center sill. The front coil trough is substantially flat and positioned about at least one of the lower edges of the front coil-receiving plates. The front coil trough is substantially aligned over the front truck connection point.

The first front coil-receiving plate is articulated generally away from the center sill beyond the front coil trough. The second front coil-receiving plate is articulated, beyond the front coil trough, as a spaced-apart, substantially mirror image of the first front coil-receiving plate such that the first and second front coil-receiving plates have space between their respective inner faces to accommodate a steel coil having as much as a large coil diameter. Each of the first and second front coil-receiving plates are substantially coupled to each of the first and the second side walls. The railcar further includes stiffeners (such as but not limited to U-shaped or L-shaped stiffeners) extending across and respectively substantially coupled to the outer face of each of the first and second front coil-receiving plates. The stiffeners are also substantially coupled to both the first and second side walls.

The railcar further includes a rear, outer-coil holding assembly sitting over the center sill and extending to each of the first and second side walls. The rear outer-coil holding assembly includes first and second rear coil-receiving plates. Each of the first and second rear coil-receiving plates have an inner face and an outer face. The inner and outer faces are bounded by a lower edge and at least two side edges. The lower edge of the first rear coil-receiving plate is substantially coupled to one of the inner or outer faces of the second rear coil-receiving plate. The lower edge the second rear coil-receiving plate is substantially coupled to the opposite of the inner or outer faces of the first rear coil-receiving plate. The rear outer-coil holding assembly has a rear coil trough substantially transverse to the longitudinal axis of the center sill. The rear coil trough is substantially flat and positioned about at least one of the lower edges of the rear coil-receiving plates. The rear coil trough is substantially aligned over the rear truck connection point.

The first rear coil-receiving plate is articulated generally away from the center sill, beyond the rear coil trough. Beyond the rear coil trough, the second rear coil-receiving plate is articulated as a spaced-apart, substantially mirror image of the first rear coil-receiving plate such that the first and second rear coil-receiving plates have space to accommodate (between their respective inner faces) a steel coil having as much as a large coil diameter. Each the first and second rear coil-receiving plates are substantially coupled to each of the first and second side walls. The stiffeners (such as the U-shaped stiffeners) extend across and are substantially coupled to the outer face of each of the first and second rear coil-receiving plates. The stiffeners (such as the U-shaped stiffeners) are each substantially coupled to both the first and second side walls.

The railcar further includes a paired plurality of inner-coil holding assemblies. Each of the plurality of inner-coil holding assemblies sits over the center sill, extends to each of the first and second side walls, and is positioned between the front and rear outer-coil holding assemblies. Each of the front and back paired inner-coil holding assembly includes first and second inner coil-receiving plates. Each of the first and second inner coil-receiving plates has inner and outer faces. The inner and outer faces are bounded by a lower edge and at least two side edges. The lower edge of the first inner coil-receiving plate is substantially coupled to one of the inner or outer faces of the second inner coil-receiving plate. The lower edge of the second inner coil-receiving plate is substantially coupled to the opposite of the inner or outer faces of the first inner coil-receiving plate. Each inner outer-coil holding assembly has an inner coil trough substantially transverse to the longitudinal axis of the center sill. The inner coil trough has substantially flat and positioned about at least one of the lower edges of the inner coil-receiving plates. The inner coil trough of the front paired inner-coil holding assembly is substantially aligned over the center sill approximately the same distance from the front truck connection point as the inner coil trough of the back paired inner-coil holding assembly is substantially aligned over the center sill from the rear truck connection point.

The first inner coil-receiving plate is articulated generally away from the center sill, beyond the inner coil trough. The second inner coil-receiving plate is articulated as a spaced-apart, substantially mirror image of the first inner coil-receiving plate such that the first and second inner coil-receiving plates have space to accommodate (between their respective inner faces) a steel coil having as much as a medium coil diameter. Each of the first and second inner coil-receiving plates is substantially coupled to each of the first and second side walls. Stiffeners (such as U-shaped stiffeners) extend across and are substantially coupled to the outer face of each of the first and second inner coil-receiving plates and are further substantially coupled to both the first and second side walls.

The railcar may further include a removable roof that circumscribes a roof void such that when the removable roof is positioned on top of the first and second side walls, steel coils held in the holding assemblies fit within the roof void. The roof void may have a layer of insulation about its periphery. Further, the removable roof may have two different heights, including two taller heights positioned over the respective outer-coil holding assemblies and a lower height positioned between the two taller heights.

These and other aspects of the present disclosure are further explained below.

BRIEF DESCRIPTION OF THE DRAWINGS

To assist those of ordinary skill in the relevant art in making and using the subject matter hereof, reference is made to the appended drawings, which disclose non-limiting and non-exhaustive embodiments that are not intended to be drawn to scale, and in which like reference numerals are intended to refer to similar elements for consistency, unless otherwise specified. For purposes of clarity, not every component may be labeled in every drawing. Non-limiting embodiments of this disclosure are described in reference to the following drawings.

DETAILED DESCRIPTION

Figure 1:
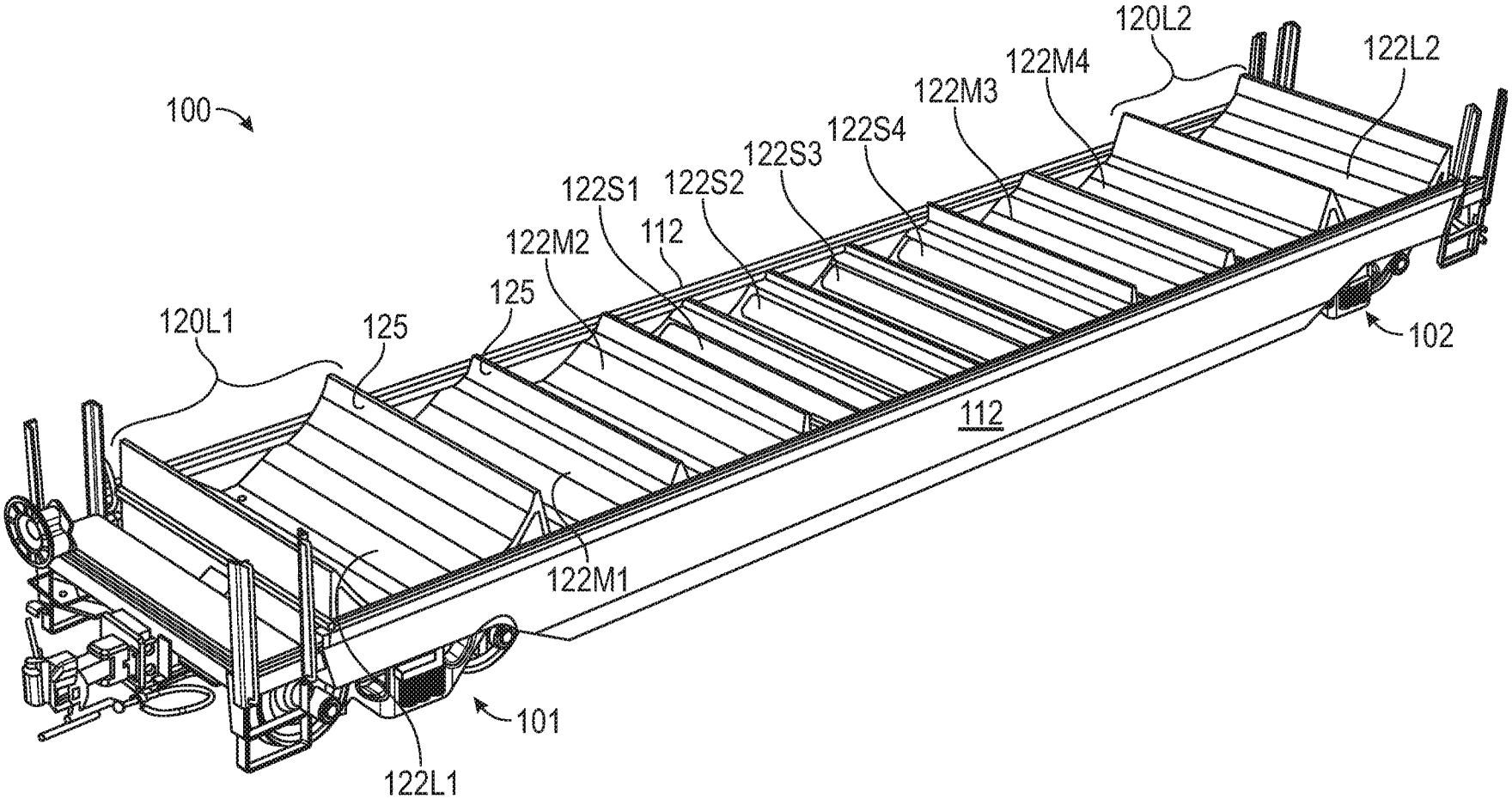
FIG. 1 of the drawings is a top perspective view of one potential example embodiment of a railcar illustrating certain potential aspects of the present disclosure.

The present disclosure now will be described more fully hereinafter with reference to the accompanying drawings, which form a part hereof, and which show, by way of illustration, specific exemplary embodiments by which the present disclosure may be practiced. This present disclosure may, however, be embodied in many different forms and should not be construed as limited to the embodiments set forth herein; rather, these embodiments are provided so that this disclosure will be thorough and complete, and will fully convey the scope of the present disclosure to those skilled in the art. Among other things, the present disclosure may be embodied as methods or devices. The following detailed description and/or arrangement of the components set forth in the following description or illustrated in the drawings is, therefore, not to be taken in a limiting sense, unless otherwise explicitly noted. In fact, the railcar embodiments described in the present disclosure are capable of other embodiments or of being practiced or carried out in various ways.

Unless otherwise defined herein, mechanical and technical terms used in connection with the present disclosure shall have the meanings that are commonly understood by those of ordinary skill in the art. Further, unless otherwise required by context, singular terms shall include pluralities and plural terms shall include the singular. The foregoing constructions are generally produced according to conventional methods well known in the art. Still, it is to be understood that the phraseology and terminology employed herein is for purposes of description, and should not be regarded as limiting.

As used in the description herein, the terms "comprises," "comprising," "includes," "including," "has," "having," or any other variations thereof, are intended to cover a non-exclusive inclusion. For example, unless otherwise noted, a process, method, article, or apparatus that comprises a list of elements is not necessarily limited to only those elements but may also include other elements not expressly listed or inherent to such process, method, article, or apparatus.

Further, unless expressly stated to the contrary, "or" refers to an inclusive and not to an exclusive "or." For example, a condition A or B is satisfied by one of the following: A is true (or present) and B is false (or not present), A is false (or not present) and B is true (or present), and both A and B are true (or present).

In addition, use of the "a" or "an" are employed to describe elements and components of the embodiments illustrated herein. This is done merely for convenience and to give a general sense of the present disclosure. This description should be read to include one or more, and the singular also includes the plural unless it is obvious that it is meant otherwise. Further, use of the term "plurality" is meant to convey "more than one" unless expressly stated to the contrary.

The use of the term "at least one" will be understood to include one as well as any quantity more than one, including but not limited to, 2, 3, 4, 5, 10, 15, 20, 30, 40, 50, 100, etc. The term "at least one" may extend up to 100 or 1000 or more, depending on the term to which it is attached; in addition, the quantities of 100/1000 are not to be considered limiting, as higher limits may also produce satisfactory results. In addition, the use of the term "at least one of X, Y, and Z" will be understood to include X alone, Y alone, and Z alone, as well as any combination of X, Y, and Z. The use of ordinal number terminology (i.e., "first," "second," "third," "fourth," etc.) is solely for the purpose of differentiating between two or more items and is not meant to imply any sequence or order or importance to one item over another or any order of addition, for example.

As used herein, the term "substantially" means that the subsequently described event or circumstance completely occurs or that the subsequently described event or circumstance occurs to a great extent or degree. For example, when associated with a particular event or circumstance, the term "substantially" means that the subsequently described event or circumstance occurs at least 80% of the time, or at least 85% of the time, or at least 90% of the time, or at least 95% of the time. For instance, the term "substantially adjacent" may mean that two items are 100% adjacent to one another, or that the two items are within close proximity to one another but are not 100% adjacent to one another, or that a portion of one of the two items is not 100% adjacent to the other item but is within close proximity to the other item. As another example, the term "substantially coupled" may mean that two items are 100% coupled (e.g., physically attached) to one another, or that the two items are at least 95%, 90%, or 85% coupled to one another.

For another example, in the context of the present disclosure, the term "substantially coupled" may be a reference to the collective or individual quantitative surface area of each of the two items that is physically attached or similarly; it may be a reference to the strength of the bond between the two items or components in the context they exist in association with the present disclosure. For example, two elongated rectangular bars may be "substantially coupled" (i.e., at least 80-100% coupled) to one another by operation of even one mechanical fastener set (e.g., a screw, nail, or nut-bolt combination) that engages both bars via a single bore. This is particularly true where the two bars are physically associated with an apparatus in such a manner as to limit the freedom of movement of the bars. Similarly, two pieces of metal may be "substantially coupled" together by welding, the substantiality of such may depend on a variety of factors understood by a person of ordinary skill in the art having the present specification, drawings, and claims before them.

As used herein, any reference to "one embodiment," "an embodiment," "some embodiments," "one example," "for example," or "an example" means that a particular element, feature, structure or characteristic described in connection with the embodiment is included in at least one embodiment. The appearance of the phrase "in some embodiments" or "one example" in various places in the specification is not necessarily all referring to the same embodiment, for example.

FIGS. 1, 2, 2A, 3, 14A, 14B, 14C, and 14D provide collective views of a potential example embodiment of railcar 100 for transporting one or more steel coils constrained by coil holding assemblies 120S, 120M, and 120L. Steel coils have long been produced in a variety of coil diameters that can be generally categorized for purposes of the present disclosure as being small (e.g., 34 inch or 42 inch in outer diameter), medium (e.g., 60 inch in outer diameter), and large (e.g., 84 inch in outer diameter). As illustrated by FIGS. 2A, 14A, 14B, 14C, and 14D, railcar 100 is configured to carry a plurality of steel coils in a variety of loading configurations that better balance the load being carried by the railcar.

As illustrated by FIGS. 2A, 14A, 14B, 14C, and 14D, the coil holding assemblies 120L, 120M, and 120S are deployed across the railcar 100 to encourage better balancing of the steel coils during transport on the railcar 100. As illustrated by FIGS. 2A, 14A, 14B, 14C, and 14D, coil holding assemblies 120L are configured to hold as much as a large diameter steel coil. Given the weight of such large diameter steel coils, railcar 100 has been configured with these large coil holding assemblies 120L at the very front and the very rear of the railcar 100 such that the loads held by these large assemblies are positioned directly over the respective front and rear truck assemblies of the railcar 100. As further illustrated by FIGS. 2A, 14A, 14B, 14C, and 14D, because large coil holding assemblies 120L are configured to hold as much as one large diameter coil, these large assemblies are alternatively capable of holding two medium diameter steel coils, two small diameter steel coils, or one medium and one small diameter steel coil side-by-side.

As further illustrated by FIGS. 2A, 14A, 14B, 14C, and 14D, medium coil holding assemblies 120M are configured to hold as much as two medium diameter steel coils. Given the weight of such medium diameter steel coils, railcar 100 has been configured with these medium coil holding assemblies 120M immediately proximal to (relative to the middle of railcar 100) the large coil holding assemblies at the very front and very rear of the railcar such that the loads held by these medium coil holding assemblies are positioned close to the front and rear truck assemblies of the railcar 100. As further illustrated by FIGS. 2A, 14A, 14B, 14C, and 14D, because medium coil holding assemblies 120M are configured to hold as much as two medium diameter coils, they are alternatively capable of holding two small diameter steel coils or one medium and one small diameter steel coil side-by-side.

Figure 14A:
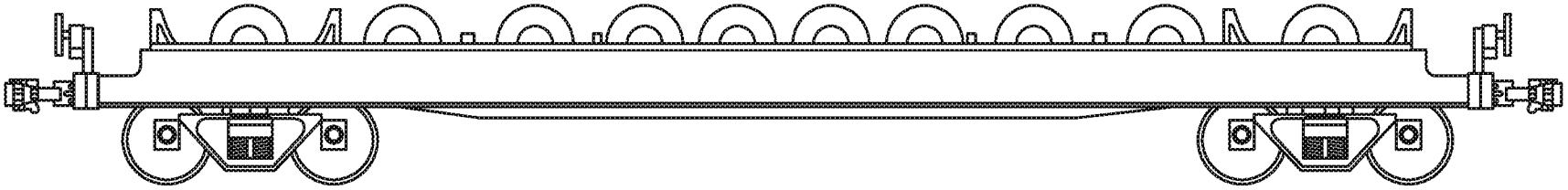
FIGS. 14A, 14B, 14C, and 14D of the drawings are side views illustrating various example steel coil loading configurations possible with one example embodiment of the railcar of the present disclosure.
Figure 14B:
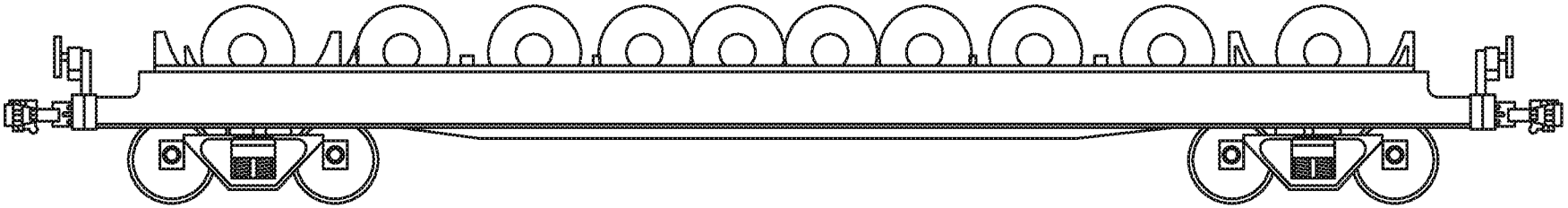
Figure 14C:
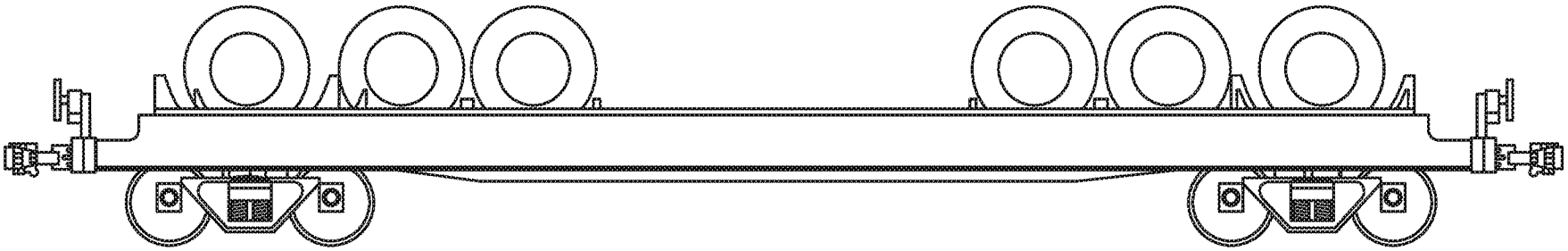
Figure 14D:
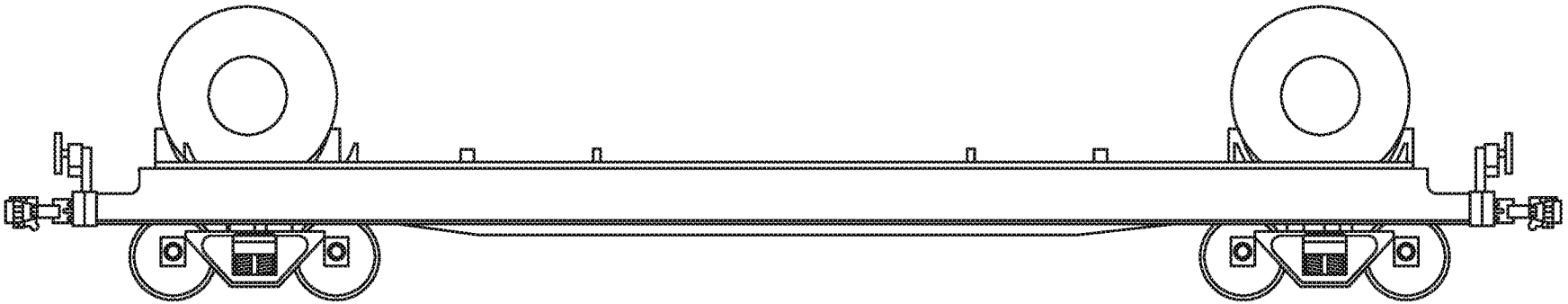

As finally illustrated by FIGS. 2A, 14A, 14B, 14C, and 14D, small coil holding assemblies 120S are configured to hold only small diameter (e.g., 34 or 42 inch) steel coils. As the relative weight of such small diameter steel coils is far less impactful on the balance of railcar 100 than that of a large steel coil, a plurality of these small coil holding assemblies 120S have been placed across the middle of railcar 100 where there is less direct support provided by the front and rear truck assemblies. FIGS. 14A and 14B illustrate that railcar 100 may be used to transport as many as 20 small diameter steel coils, or as many as 20 medium diameter steel coils, or as few as two large steel coils (see FIG. 14D).

Figure 2:
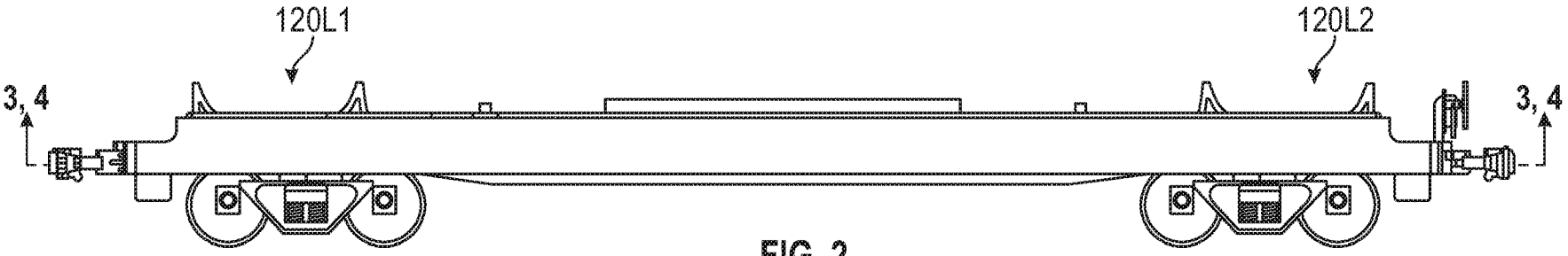
FIG. 2 of the drawings is a side elevation view of the railcar of FIG. 1.
Figure 2A:
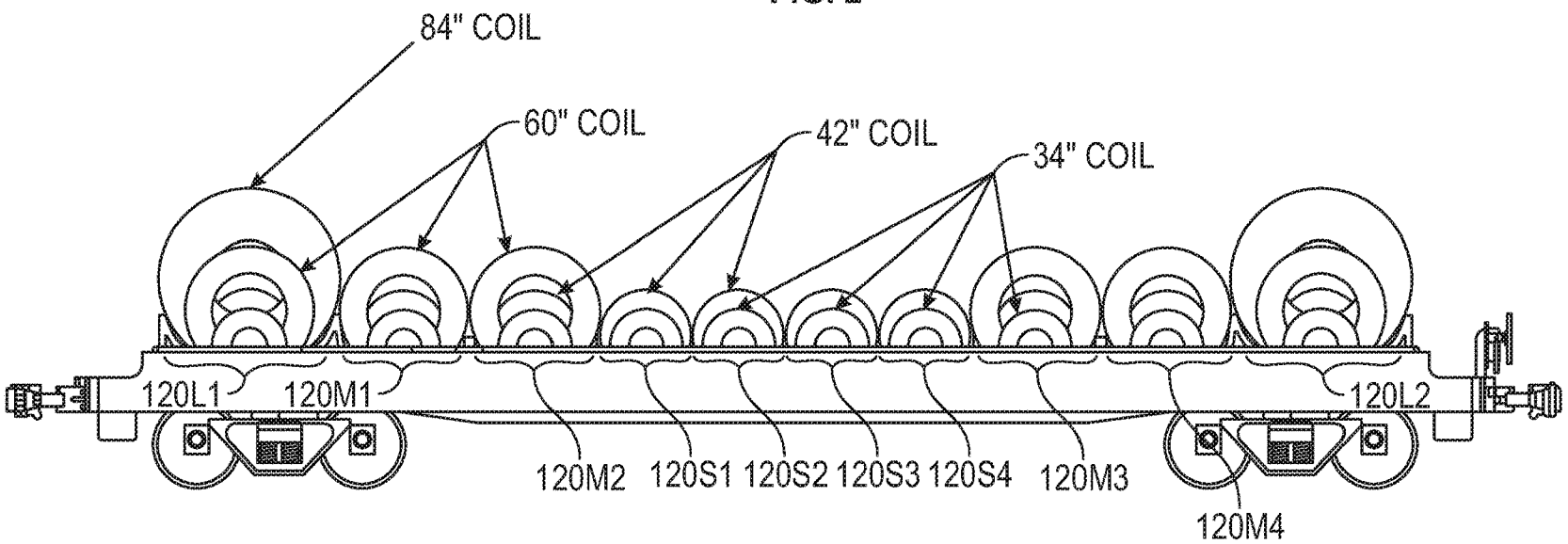
FIG. 2A of the drawings is a side elevation view of the railcar of FIG. 1, illustrating various potential steel coil loading configurations associated therewith.

As is standard, railcar 100 has a front truck assembly 101 and a rear truck assembly 102. The front truck assembly 101 has at least one pair of front truck wheels, an axle coupled to each of the one pair of front truck wheels, and a front truck connection point positioned on the front truck assembly to distribute a load placed on the front truck assembly substantially evenly. As shown in FIGS. 1 and 2, more preferably, the front truck assembly 101 has two pairs of front truck wheels, each pair of front truck wheels being coupled to an axle. The rear truck assembly 102 has at least one pair of rear truck wheels, an axle coupled to each pair of rear truck wheels, and a rear truck connection point positioned on the rear truck assembly to distribute a load placed on the rear truck assembly substantially evenly. As shown in FIGS. 1 and 2, more preferably, the rear truck assembly 102 has two pairs of rear truck wheels, each pair of rear truck wheels being coupled to an axle. Often, front and rear truck assemblies may include shock absorption and other systems. For instance, although not illustrated in the figures, a person of skill in the art would expect the front and rear truck assemblies to further include a braking system.

Figure 3:
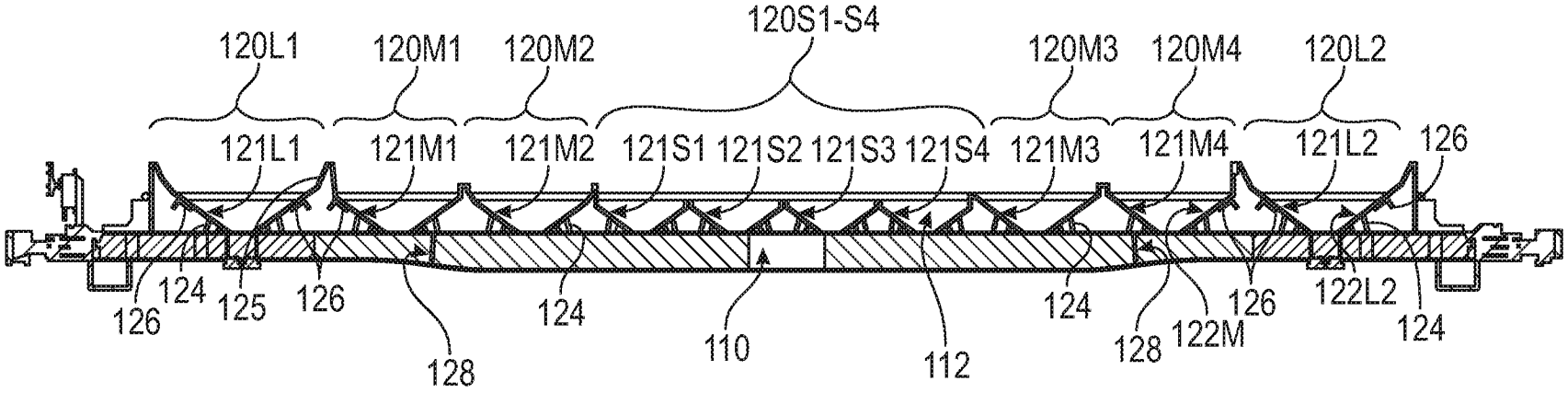
FIG. 3 of the drawings is a side elevation cross-sectional view of the railcar of FIG. 1 taken substantially along line 3-3 in FIG. 2.
Figure 4:
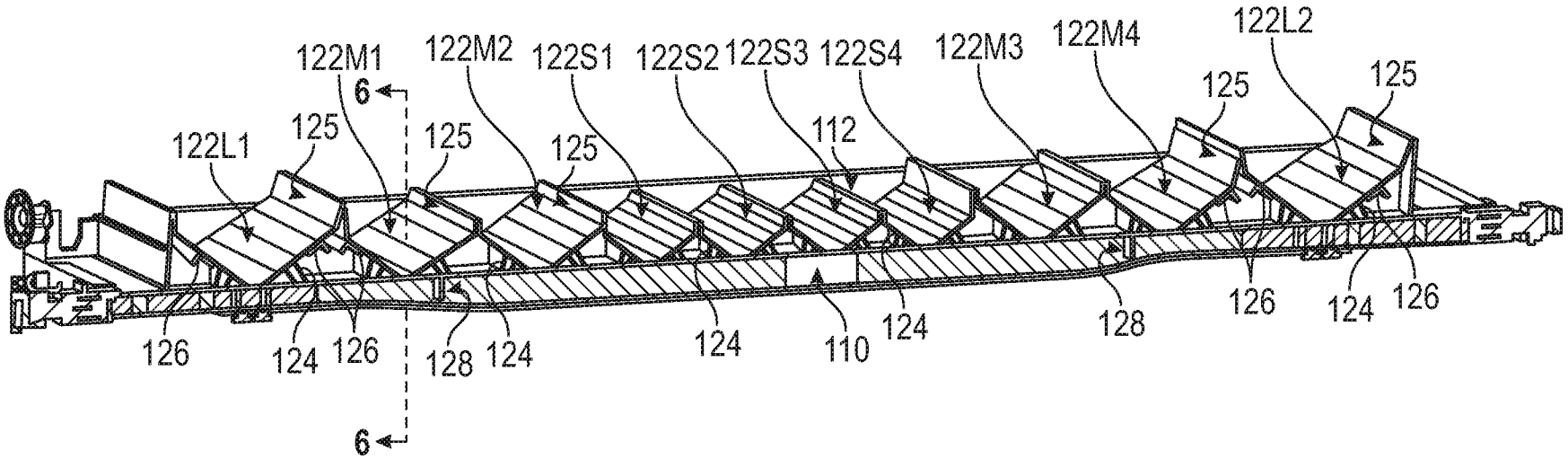
FIG. 4 of the drawings is a top perspective cross-sectional view of the railcar of FIG. 1.

As illustrated in FIGS. 3, 4, 9, and 10, railcar 100 further includes a center sill assembly 110 operably supported at the front truck connection point by the front truck assembly 101 and at a rear truck connection point by the rear truck assembly 102. The center sill assembly 110 includes a center sill 111 that is located at the midline of railcar 100 and is substantially aligned with the railcar's direction of travel. Thus, the disclosure will refer to the center sill 111 as having a longitudinal axis. As shown in FIGS. 3 and 4, the center sill 111 may also include several T-shaped support members 128. These T-shaped support members 128 preferably extend only the width of the center sill 111.

Figure 9:
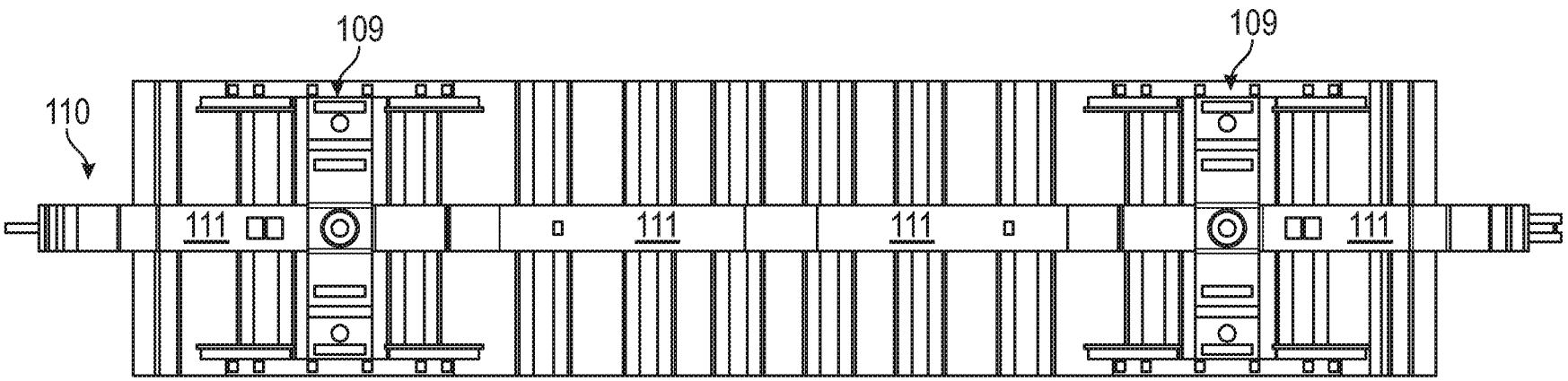
FIG. 9 of the drawings is a bottom plan view of the railcar of FIG. 1.

FIG. 9 illustrates that the center sill assembly 110 further preferably includes two body bolsters 109 connected to the center sill 111 proximate to each end of railcar 100 and more preferably, directly over a respective one of the front or rear truck assemblies. Each body bolster 109 extends laterally from the center sill 111 at a substantially perpendicular angle thereto. The span of each body bolster 109 should be no bigger than eleven feet from end to end (based on the maximum width for railcars in the United States) in various embodiments of the present disclosure. The center sill assembly 110 functions as the backbone of railcar 100 and carries the load of the railcar 100 and transfers that load to the front and rear truck assemblies 101 and 102. The center sill assembly 110 also facilitates connections between railcar 100 and adjacent railcars (not shown) in a suitable manner such as via conventional coupler assemblies.

As shown in FIG. 1, the railcar 100 also preferably includes spaced-apart first and second side walls 112. The first side wall 112 is supported by and coupled to a first outer end of each body bolster 109 of center sill assembly 110 such that the first side wall 112 is spaced-apart from and substantially parallel to the longitudinal axis of the center sill 111 on a first side of that longitudinal axis. The second side wall 112 is likewise supported by and coupled to a second outer end of each body bolster 109 of the center sill assembly 110 such that the second side wall 112 is spaced-apart from and substantially parallel to the longitudinal axis on a second side of the longitudinal axis.

As noted above, railcar 100 includes a plurality of coil holding assemblies 120 that are disposed over the center sill assembly 110 and extend between the first and second side walls 112. Starting from the front end of the railcar 100 (see FIGS. 1, 2A, 3 and 4), there is a front, outer-coil holding assembly 120L1 that includes a first front coil-receiving plate 121L1 and a second front coil-receiving plate 122L1. Each of these first and second front coil-receiving plates has an inner face and an outer face. The inner and outer faces are bounded by a lower edge and at least two side edges. More preferably, as shown in certain figures (see, e.g., FIGS. 4 and 5), the inner and the outer faces are bounded by a lower edge, two side edges, and an upper edge, such that the first and second front coil-receiving plates are substantially rectangular.

Figure 8:
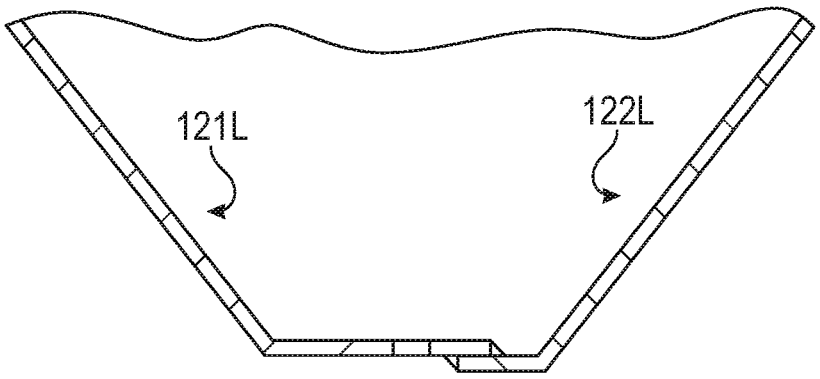
FIG. 8 of the drawings is a side elevation, cross-sectional view of part of the railcar of FIG. 1 taken substantially along line 8-8 of FIG. 5.

The present disclosure contemplates various different configurations for the configuration and connection of the first coil-receiving plate and the second front coil-receiving plate of each of the coil holding assemblies of the railcar. In one example embodiment of the present disclosure, as best seen in FIG. 8, the lower edge of the first front coil-receiving plate 121L1 is substantially coupled to one of the inner or outer faces of the second front coil-receiving plate 122L1 and the lower edge of the second front coil-receiving plate 122L1 is substantially coupled to the opposite of the inner or outer faces of the first front coil-receiving plate 121L1. In other words, in various embodiments, the first front coil-receiving plate 121L1 includes a first bottom foot (not labeled) extending toward the second coil-receiving plate, and the second coil-receiving plate 122L1 includes a second bottom foot (not labeled) extending toward the first coil-receiving plate. In this illustrated example embodiment, the first bottom foot is longer than the second bottom foot. In other example embodiments, the second bottom foot is longer than the first bottom foot. In this illustrated example embodiment, the longer first bottom foot overlaps the shorter second bottom foot. In other example embodiments, the longer bottom foot is overlapped by the shorter bottom foot. This overlapping arrangement facilitates easier construction of each coil holding assembly and accounts for various manufacturing tolerances and other manufacturing and configuration issues. In various embodiments, these plates and specifically these bottom feet are suitably substantially attached or coupled together. This substantial coupling between the first and second front coil-receiving plates is preferably accomplished by welding the plates (and specifically the feet) together using a fillet weld to form a lap joint between the first and second front coil-receiving plates. In particular, in various example embodiments, it is contemplated that the first and second coil-receiving plates will be overlapped by approximately 0.5 to 1.0 inches to form the lap joint. It should also be appreciated that this configuration partially enables each of the coil holding assemblies to be constructed separately and then positioned and attached to the center sill and the side walls of the railcar.

It should be appreciated from the above that in various embodiments, the present disclosure contemplates a railcar for transporting one or more steel coils, each steel coil having a coil diameter, wherein the railcar includes: (a) a front truck assembly including at least one pair of front truck wheels, an axle coupled to each pair of front truck wheels; (b) a rear truck assembly including at least one pair of rear truck wheels, an axle coupled to each pair of rear truck wheels; (c) a center sill assembly operably supported by the front truck assembly and by the rear truck assembly, the center sill having a longitudinal axis; (d) a first side wall supported by and substantially coupled to the center sill assembly such that the first side wall is spaced-apart from and substantially parallel to the longitudinal axis on a first side of the longitudinal axis; (e) a second side wall supported by and substantially coupled to the center sill assembly such that the second side wall is spaced-apart from and substantially parallel to the longitudinal axis on a second side of the longitudinal axis; and (f) a plurality of coil holding assemblies sitting over the center sill and extending to each of the first and second side walls, wherein each coil holding assembly includes a first coil-receiving plate and a second coil-receiving plate that partially define a coil trough substantially transverse to the longitudinal axis of the center sill, the first coil-receiving plate including a first bottom foot extending toward the second coil-receiving plate, the second front coil-receiving plate including a second bottom foot extending toward the first coil-receiving plate, the first bottom foot being longer than the second bottom foot, and the first bottom foot and the second bottom foot being attached in an overlapping configuration. In various such embodiments, the longer first bottom foot is overlapped by the shorter second bottom foot. In various such embodiments, the shorter second bottom foot is welded to the longer first bottom foot.

As shown in FIG. 1, the inner face of the first and second coil-receiving plates may have mounted thereon one or more substantially linear coil bumper strips. FIG. 1 shows the use of three such strips. Any suitable quantity of strips or other coil engagement members may be employed in accordance with the present disclosure. These example strips are preferably made of two-inch-wide compressible materials capable of withstanding high temperatures while maintaining its resiliency. This material may be hollow in some constructions. One material that may be used for this application is manufactured by Wabtec Corporation of Wilmerding, Pa. under the name ZefTek®. FIG. 1 further discloses (along with FIGS. 3 and 4) the potential addition of one or more optional stabilizer bars 125. Where desired, each stabilizer bar 125 would be substantially coupled to the upper edge of one or more of the coil-receiving plates. When installed, each stabilizer bar 125 is believed to provide an additional physical barrier to minimize the ability of a steel coil to roll free, particularly following a train derailment or crash.

In various example embodiments, with the first and second coil-receiving plates substantially coupled together, the first and second front coil-receiving plates 121L1 and 122L1 are bent into their desired shape, preferably using a press break. In various embodiments, the outer-coil holding assembly 120L1 has, as shown in FIG. 5:

a. a front coil trough 123L1 (substantially transverse to the longitudinal axis of the center sill 111) that is substantially flat and positioned about at least one of the lower edges of the front coil-receiving plates 121L1 and 122L1, b. the first front coil-receiving plate 121L1 articulated, e.g., bent, (to the outside of the front coil trough 123L1) generally away from the center sill, and c. the second front coil-receiving plate 122L1 articulated, e.g., bent, (beyond the front coil trough) as a spaced-apart, substantially mirror image of the first front coil-receiving plate 121L1 such that the first and second front coil-receiving plates 121L1 and 122L1 have space to accommodate (between their respective inner faces) a steel coil having as much as a large coil diameter.

Figure 5:
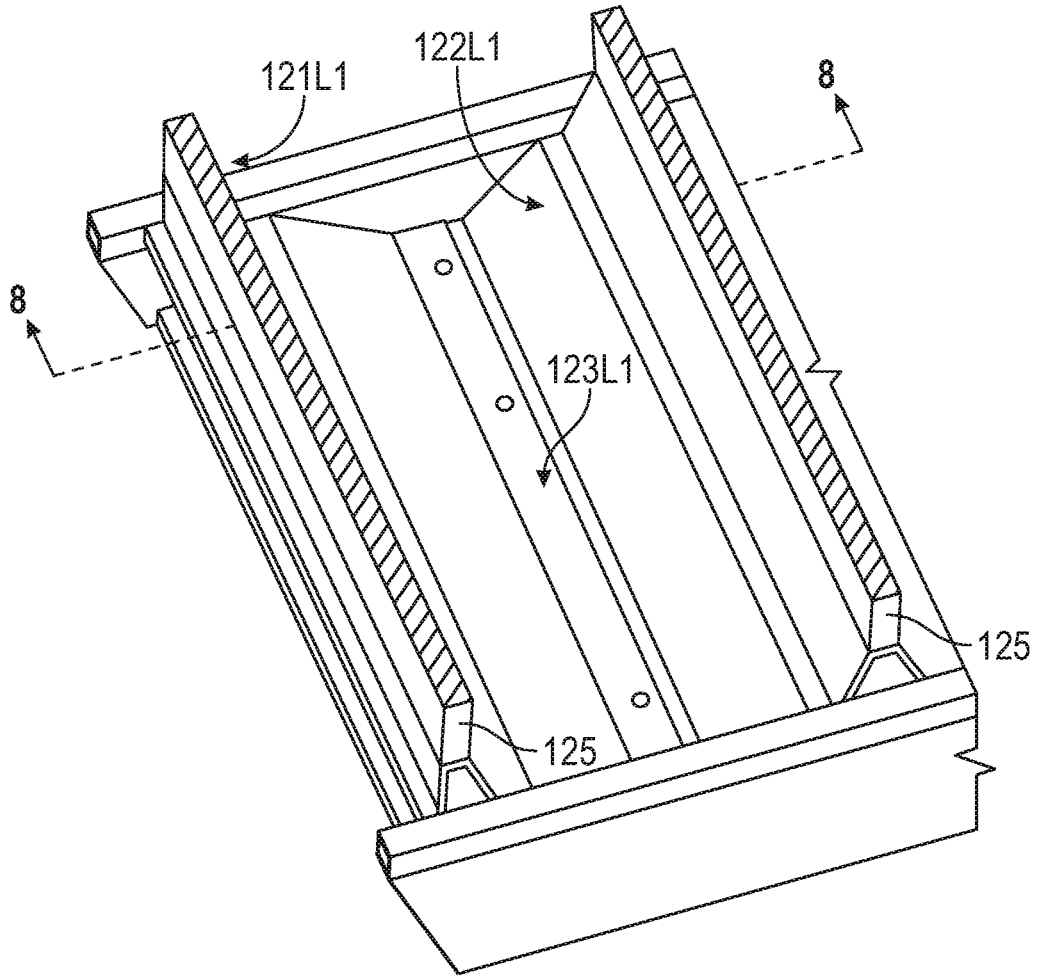
FIG. 5 of the drawings is a top perspective view of the front, outer-coil holding assembly of the railcar of FIG. 1.
Figure 6:
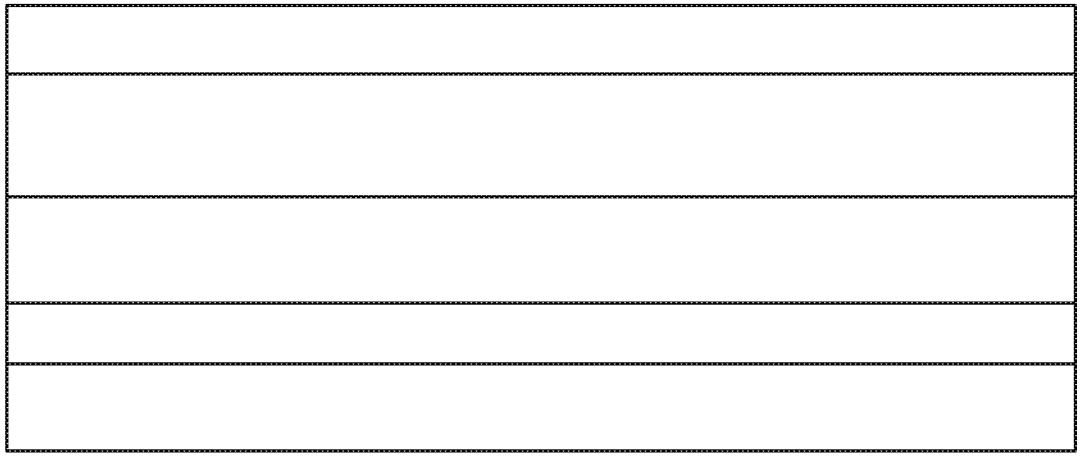
FIG. 6 of the drawings is an elevation view of the railcar of FIG. 1 taken substantially along line 6-6 of FIG. 4.

FIG. 5 also discloses that the coil holding assemblies may have included one or more drain holes in the coil trough to allow for the drainage of water and other fluids that may accumulate at the bottom of a coil holding assembly.

Figure 7:
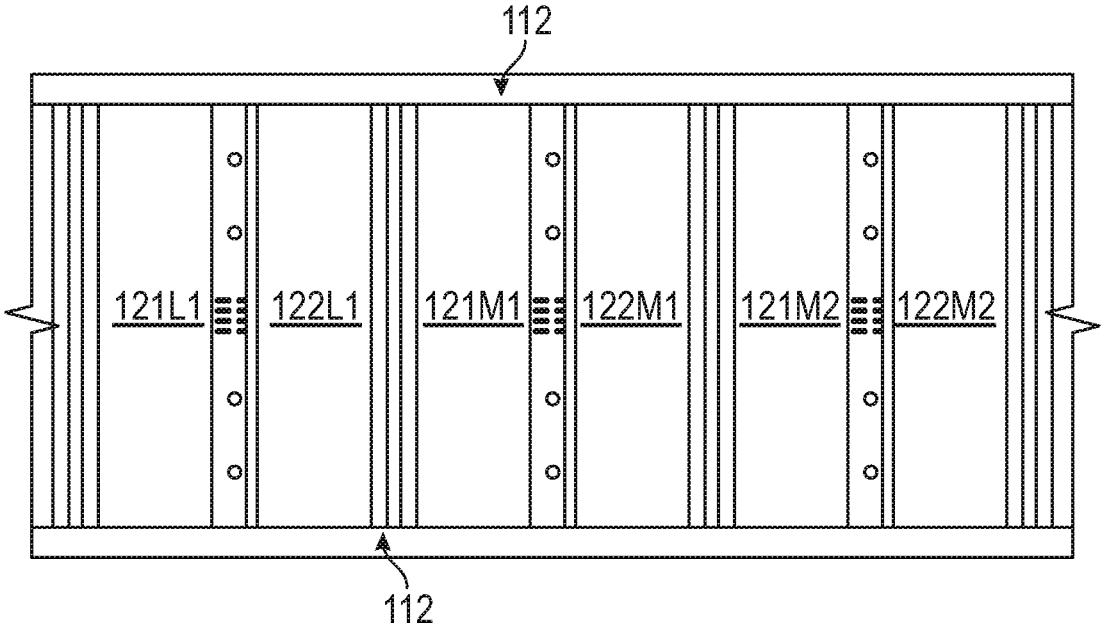
FIG. 7 of the drawings is a top plan view of a portion of the railcar of FIG. 1.
Figure 10:
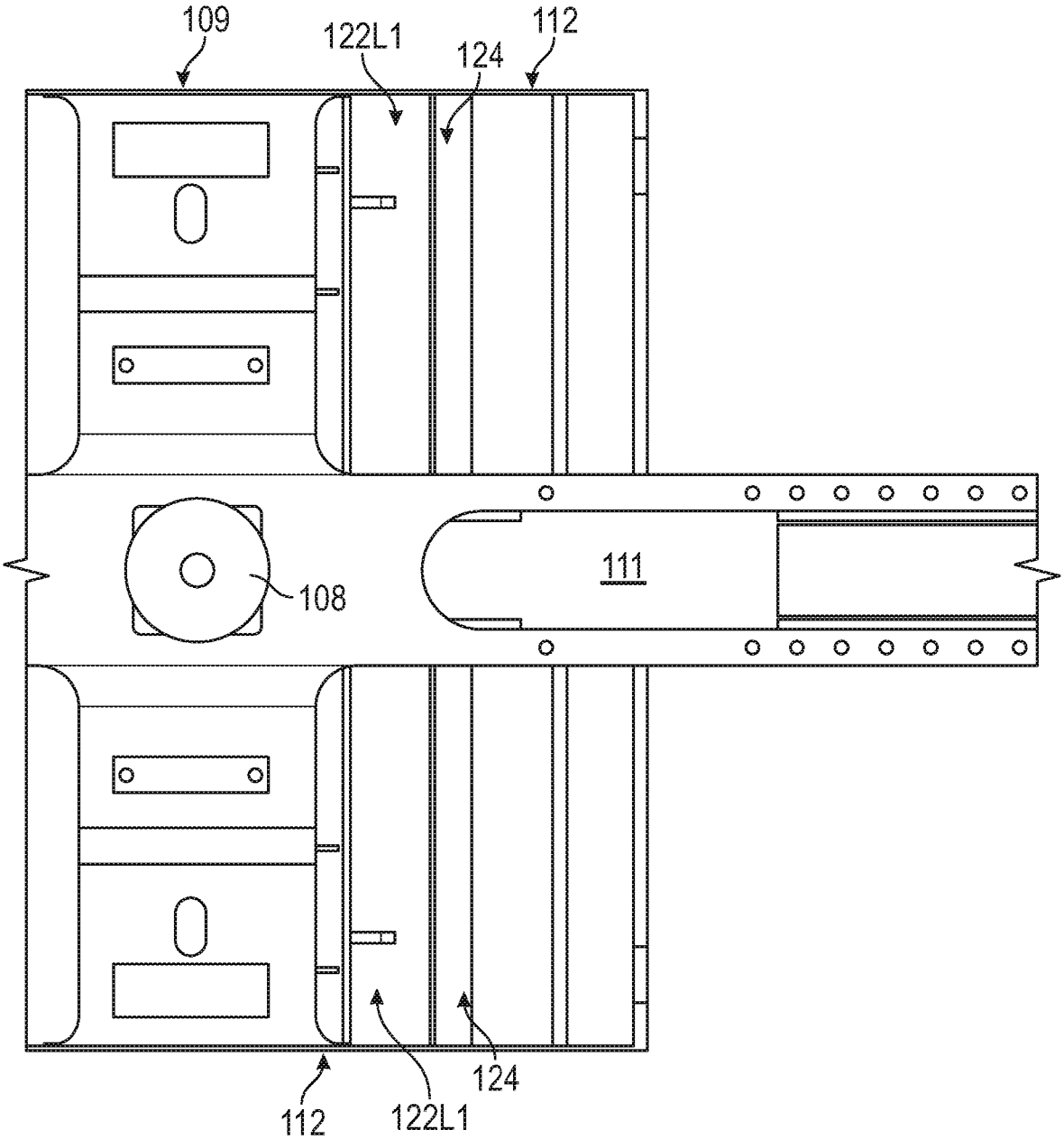
FIG. 10 of the drawings is a bottom plan view of a portion of the railcar of FIG. 1.

With reference to FIG. 7, it can be seen that each of the side edges of the first and second front coil-receiving plates 121L1 and 122L1 abut the first and second side walls 112 of railcar 100. The side walls of the first and second front coil-receiving plates 121L1 and 122L1 are substantially coupled to the first and second side walls 112. Preferably, this substantial coupling involves welding a T-joint between each coil-receiving plate 121L1 and 122L1 and a respective side wall 112. As visible in FIGS. 3 and 4, the front, outer-coil holding assembly 120L1 further includes stiffeners such as, but not limited to, U-shaped stiffeners 124 extending across and substantially coupled to the respective outer faces of each of the first and second front coil-receiving plates 121L1 and 122L1, and wherein the stiffeners, such as the U-shaped stiffeners 124, physically ride on top of the center sill 111. Each stiffener, such as the U-shaped stiffener 124, is substantially coupled to both the first and second side walls 112. In particular, in this example, the U-shaped stiffeners 124 are preferably respectively welded at both ends to the outer faces of the coil-receiving plates 121 and 122 and the railcar side walls 112 using a fillet welding technique. The relationship of the example U-shaped stiffeners 124 and the outer face of a coil-receiving plate is partially visible in FIG. 10. FIG. 10 (in conjunction with FIG. 9) also illustrates that the front, outer-coil holding assembly 120L1 is positioned on the railcar 100 such that the front coil trough 123L1 (FIG. 5) is substantially aligned over the front truck connection point, which connection point is aligned with center plate 108 of the center sill assembly 110. Also visible in FIGS. 3 and 4, the front, outer-coil holding assembly 120L1 further includes stiffeners such as L-shaped stiffeners 126 extending across and substantially respectively coupled to the outer faces of each of the first and second front coil-receiving plates 121L1 and 122L1. Each example L-shaped stiffener 126 is substantially coupled to both the first and second side walls 112. In particular, the L-shaped stiffeners 126 are preferably welded to the outer faces of the coil-receiving plates 121 and 122 and the railcar side walls 112 using a fillet welding technique. More specifically, each example L-shaped stiffener may be welded at a single end to the outer faces of each of the coil receiving plates, rather than the two-ended coupling for the U-shaped stiffeners.

It should be appreciated that the transversely extending stiffeners that are suitably attached such as by welding to the respective outer faces of the coil-receiving plates and to the side walls as described herein, may be U-shaped, L-shaped, or another suitable shape (such as but not limited to a tubular shape). It should also be appreciated that the transversely extending stiffeners are configured to transfer loads from the coil-receiving plates to the side walls and the center sill.

Turning now to the back end of the railcar 100, there is a rear, outer-coil holding assembly 120L2 that includes first and second rear coil-receiving plates 121L2 and 122L2, respectively. Each of these first and second rear coil-receiving plates has an inner face and an outer face. As shown in the figures (see, e.g., FIGS. 4 and 5), these inner and outer faces are bounded by a lower edge and at least two side edges. More preferably, the inner and outer faces are bounded by a lower edge, two side edges, and an upper edge, such that the first rear coil-receiving plate 121L2 and second rear coil-receiving plate 122L2 are substantially rectangular. The lower edge of the first rear coil-receiving plate 121L2 is substantially coupled to one of the inner or outer faces of the second rear coil-receiving plate 122L2 and the lower edge of the second rear coil-receiving plate 122L2 is substantially coupled to the opposite of the inner or outer faces of the first rear coil-receiving plate 121L2. This substantial coupling between the first and second rear coil-receiving plates is preferably accomplished by substantially welding the plates together using a fillet weld to form a lap joint or overlapping joint between the first and second rear coil-receiving plates. In particular, it is contemplated that the first and second coil-receiving plates will be overlapped by approximately 0.5 to 1.0 inches to form the lap joint. It should be appreciated that these plates include the overlapping bottom feet as describe above.

In various example embodiments, with the plates substantially coupled together, the first and second rear coil-receiving plates are bent into their desired shape preferably using a press break. The outer-coil holding assembly 120L2 has:

a. a rear coil trough 123L2 (not shown) (substantially transverse to the longitudinal axis of the center sill) that is substantially flat and positioned about at least one of the lower edges of the rear coil-receiving plates 121L2 and 122L2, b. the first rear coil-receiving plate 121L2 articulated, e.g., bent, (beyond the coil trough) generally away from the center sill 111, and c. the second rear coil-receiving plate 122L2 articulated, e.g., bent, (beyond the coil trough) as a spaced-apart, substantially mirror image of the first rear coil-receiving plate such that the first and second rear coil-receiving plates 121L2 and 122L2 have space to accommodate (between their respective inner faces) a steel coil having as much as a large coil diameter.

Each of the side edges of the first and second rear coil-receiving plates 121L2 and 122L2 is substantially coupled to a respective one of the first and second side walls 112. Preferably, this substantial coupling involves welding a T-joint between each coil-receiving plate 121L2 and 122L2 and a respective side wall 112. The rear, outer-coil holding assembly 120L2 further includes stiffeners such as U-shaped stiffeners 124 extending across and substantially respectfully coupled (preferably by welding) to the outer faces of each of the first rear coil-receiving plate 121L2 and second rear coil-receiving plate 122L2, and wherein the U-shaped stiffeners 124 physically ride on top of the center sill 111. Each U-shaped stiffener 124 is also substantially coupled to both the first and second side walls 112. In particular, the U-shaped stiffeners 124 are preferably welded at both ends to the respective outer faces of the coil-receiving plates 121 and 122 and the railcar side walls 112 using a fillet welding technique. The rear, outer-coil holding assembly 120L2 is positioned on the railcar 100 such that the rear coil trough 123L2 is substantially aligned over the rear truck connection point. Also visible in FIGS. 3 and 4, the rear, outer-coil holding assembly 120L2 further includes L-shaped stiffeners 126 extending across and substantially coupled to the outer face of each of the first and second front coil-receiving plates 121L2 and 122L2. The L-shaped stiffener 126 is substantially coupled to both the first and second side walls 112. In particular, the L-shaped stiffeners 126 are preferably welded to the respective outer faces of the coil-receiving plates 121 and 122 and the railcar side walls 112 using a fillet welding technique. More specifically, the L-shaped stiffeners may be welded at a single end to the outer faces of each of the coil receiving plates, rather than the two-ended coupling for the U-shaped stiffeners.

Next, the railcar 100 has a plurality of paired inner-coil holding assemblies (120M and 120S) positioned between the front and rear outer-coil holding assemblies, with each assembly sitting over the center sill and extending to each of the first and second side walls 112. Each of the inner-coil holding assemblies (120M and 120S) includes first and second inner coil-receiving plates. Each of the first and second inner coil-receiving plates has an inner face and an outer face. The inner and outer faces are bounded by a lower edge and at least two side edges. The lower edge of the first inner coil-receiving plate is substantially coupled to one of the inner or outer faces of the second inner coil-receiving plate. The lower edge of the second inner coil-receiving plate is substantially coupled to the opposite of the inner or outer faces of the first inner coil-receiving plate. In particular, it is contemplated that the first and second coil-receiving plates will be overlapped by approximately 0.5 to 1.0 inches to form this lap joint. It should be appreciated that these plates include the overlapping bottom feet as describe above.

In various example embodiments, with the plates substantially coupled together, the first and second inner coil-receiving plates are bent into their desired shape preferably using a press break, such that each inner-coil holding assembly has:

a. an inner coil trough substantially transverse to the longitudinal axis of the center sill, wherein the inner coil trough is substantially flat and positioned about at least one of the lower edges of the inner coil-receiving plates,
b. the first inner coil-receiving plate is articulated, e.g., bent, (beyond the inner coil trough) generally away from the center sill and
c. the second inner coil-receiving plate is articulated, e.g., bent, (beyond the inner coil trough) beyond the inner coil trough, as a spaced-apart, substantially mirror image of the first inner coil-receiving plate such that the first and second inner coil-receiving plates have space to accommodate (between their respective inner faces) a steel coil having as much as a medium coil diameter.

Each of the side edges of the first and second inner coil-receiving plates is substantially coupled to each of the first and second side walls 112. Stiffeners such as U-shaped stiffeners 124 extend across and are substantially coupled to the respective outer faces of each of the first and second inner coil-receiving plates and to both the first and second side walls. The example U-shaped stiffeners 124 physically ride on top of the center sill 111. In particular, the U-shaped stiffeners 124 are preferably welded at both ends to the outer faces of the coil-receiving plates 121 and 122 and the railcar side walls 112 using a fillet welding technique. The inner coil trough of the front paired inner-coil holding assembly is substantially aligned over the center sill approximately the same distance from the front truck connection point as the inner coil trough of the back paired inner-coil holding assembly is substantially aligned over the center sill from the rear truck connection point.

Figure 11:
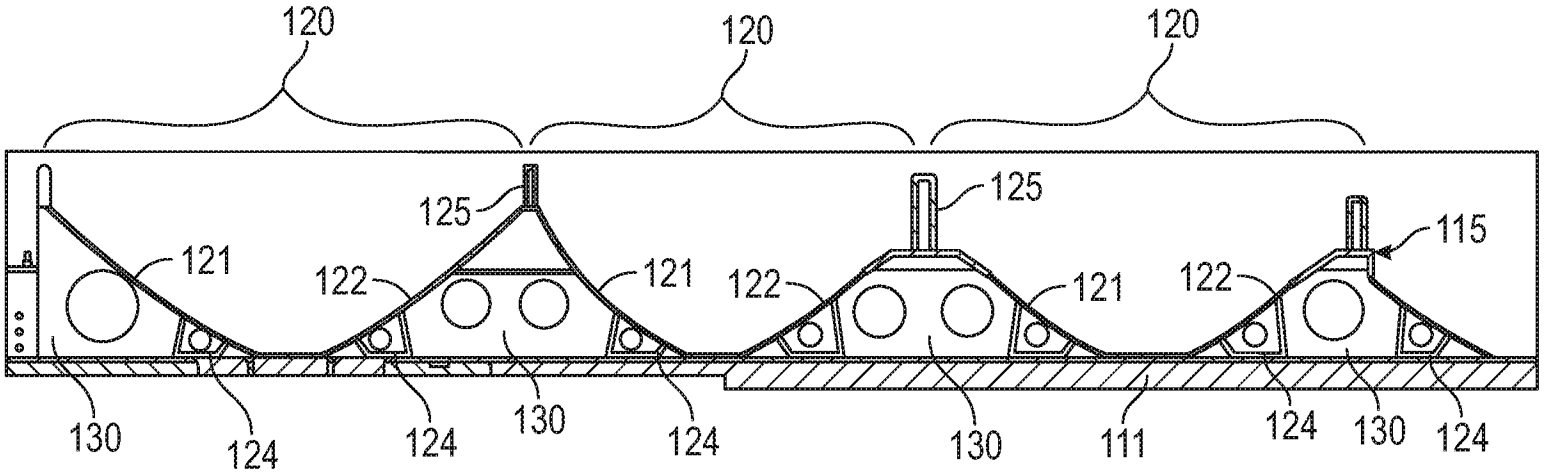
FIG. 11 of the drawings is a cross-sectional, partial schematic view of another potential alternative example embodiment of a railcar illustrating other potential aspects of the present disclosure.
Figure 12:
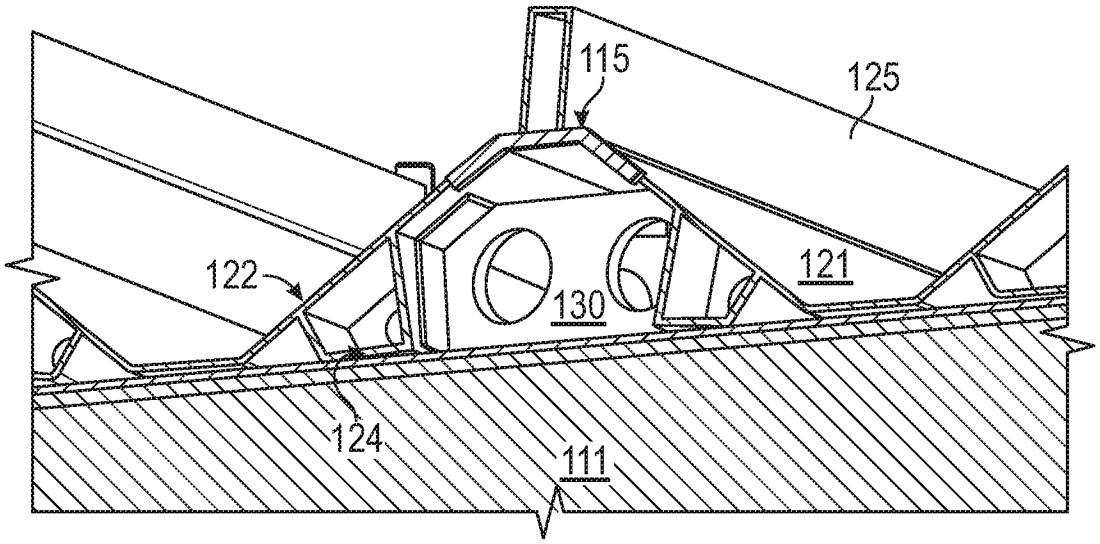
FIG. 12 of the drawings is a perspective, cross-sectional, partial schematic view of the alternative example embodiment of the railcar of FIG. 11.
Figure 13:
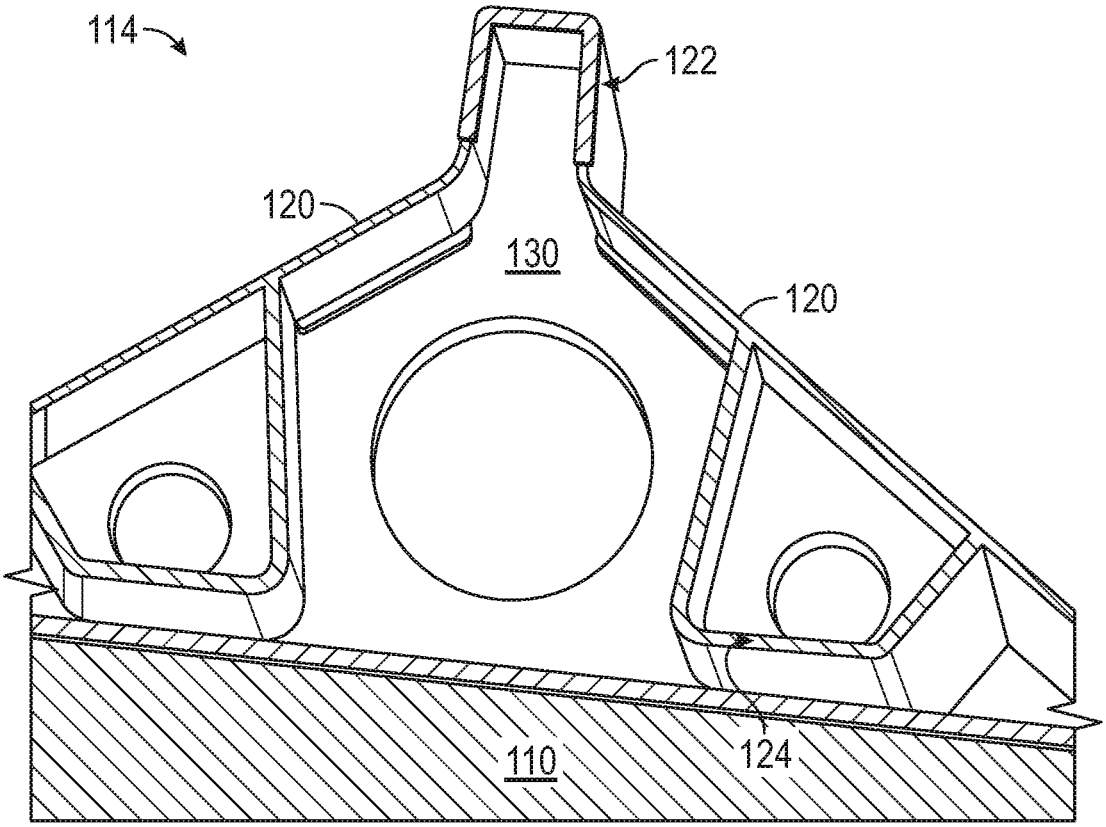
FIG. 13 of the drawings is a side-elevation, cross-sectional, partial schematic view of the alternative example embodiment of the railcar of FIG. 11.

FIGS. 11, 12, and 13 show part of another potential alternative example embodiment of the railcar illustrating other potential aspects of the present disclosure. The part 114 includes two adjacent coil holding assemblies 120. One particular difference between this alternative example embodiment and the first embodiment (described above) is the addition of at least one (and more preferably two) example anti-deformation plate 130 inserted transversely to the longitudinal axis of at least one of the stiffeners, such as the U-shaped stiffeners 124. This anti-deformation plate 130 provides support to an associated stiffener such as the U-shaped stiffener 124 to minimize the likelihood that the stiffeners and/or the plates will deform under the physical pressure caused by the presence of a steel coil in the holding assembly. It should be appreciated that the anti-deformation plates may be different sizes with respect to the different size coil holding assemblies. It should be appreciated that the anti-deformation plates may each include one or more openings (such as the illustrated circular spaced apart openings) to reduce the weight of the anti-deformation plates and the railcar without substantially reducing the amount of support provided by such anti-deformation plates.

It should thus be appreciated that various embodiments of the present disclosure provide a railcar for transporting one or more steel coils, each steel coil having a coil diameter, wherein the railcar includes: (a) a front truck assembly including at least one pair of front truck wheels and an axle coupled to each pair of front truck wheels; (b) a rear truck assembly including at least one pair of rear truck wheels, and an axle coupled to each pair of rear truck wheels; (c) a center sill assembly operably supported by the front truck assembly and by the rear truck assembly, the center sill having a longitudinal axis; (d) a first side wall supported by and substantially coupled to the center sill assembly such that the first side wall is spaced-apart from and substantially parallel to the longitudinal axis on a first side of the longitudinal axis; (e) a second side wall supported by and substantially coupled to the center sill assembly such that the second side wall is spaced-apart from and substantially parallel to the longitudinal axis on a second side of the longitudinal axis; and (f) a plurality of coil holding assemblies sitting over the center sill and extending to each of the first and second side walls, wherein each coil holding assembly includes a first coil-receiving plate and a second coil-receiving plate that partially define a coil trough substantially transverse to the longitudinal axis of the center sill, and an anti-deformation plate extending under the first coil-receiving plate and the second coil-receiving plate and extending over the center sill. In various such embodiments, each of the plurality of coil holding assemblies includes a first stiffener extending across and substantially coupled to an outer face of the first coil-receiving plate, the first stiffener being substantially coupled to both the first and second side walls, and a second stiffener extending across and substantially coupled to an outer face of the second coil-receiving plate, the second stiffener being substantially coupled to both the first and second side walls.

FIGS. 11, 12, and 13 show another difference of this example embodiment, the absence of L-shaped stiffeners in this example embodiment.

FIGS. 11 and 12 also show the use of a cap 115 to provide a closure (such as a cosmetic closure) between or for the plates of adjacent coil holding assemblies. FIGS. 11 and 13 also shows different example forms of this cap and different example forms of the stabilizer 125.

It should further be appreciated from the above that the present disclosure includes a railcar for transporting one or more steel coils, each steel coil having a coil diameter, wherein the railcar includes: (a) a front truck assembly including at least one pair of front truck wheels, and an axle coupled to each pair of front truck wheels; (b) a rear truck assembly including at least one pair of rear truck wheels, and an axle coupled to each pair of rear truck wheels; (c) a center sill assembly operably supported by the front truck assembly and by the rear truck assembly, the center sill having a longitudinal axis; (d) a first side wall supported by and substantially coupled to the center sill assembly such that the first side wall is spaced-apart from and substantially parallel to the longitudinal axis on a first side of the longitudinal axis; (e) a second side wall supported by and substantially coupled to the center sill assembly such that the second side wall is spaced-apart from and substantially parallel to the longitudinal axis on a second side of the longitudinal axis; and (f) a plurality of coil holding assemblies sitting over the center sill and extending to each of the first and second side walls, wherein each coil holding assembly includes: (i) a first coil-receiving plate and a second coil-receiving plate that partially define a coil trough substantially transverse to the longitudinal axis of the center sill, (ii) a first stiffener extending across and substantially coupled to an outer face of the first coil-receiving plate, the first stiffener being substantially coupled to both the first and second side walls, and (iii) a second stiffener extending across and substantially coupled to an outer face of the second coil-receiving plate, the second stiffener being substantially coupled to both the first and second side walls. In various such embodiments, for at least one of the plurality of coil holding assemblies, the first stiffener is U-shaped and the second stiffener is U-shaped. In various such embodiments, for one of the plurality of coil holding assemblies, the first stiffener is L-shaped and the second stiffener is L-shaped. In various such embodiments, for at least one of the plurality of coil holding assemblies, the first stiffener is L-shaped and the second stiffener is L-shaped. In various such embodiments, at least one of the plurality of coil holding assemblies includes an anti-deformation plate transversely extending to the stiffeners. In various such embodiments, the anti-deformation plate extends over the center sill. In various such embodiments, each of the plurality of coil holding assemblies includes an anti-deformation plate transversely extending to the stiffeners. In various such embodiments, each of the anti-deformation plates extends over the center sill.

It should further be appreciated from the above that the present disclosure includes a railcar for transporting one or more steel coils, each steel coil having a coil diameter, wherein the railcar includes: (a) a front truck assembly including at least one pair of front truck wheels, an axle coupled to each pair of front truck wheels, and a front truck connection point positioned to distribute a load placed on the front truck assembly substantially evenly; (b) a rear truck assembly including at least one pair of rear truck wheels, an axle coupled to each pair of rear truck wheels, and a rear truck connection point positioned to distribute a load placed on the rear truck assembly substantially evenly; (c) a center sill assembly operably supported at the front truck connection point by the front truck assembly and at a rear truck connection point by the rear truck assembly, the center sill having a longitudinal axis; (d) a first side wall supported by and substantially coupled to the center sill assembly such that the first side wall is spaced-apart from and substantially parallel to the longitudinal axis on a first side of the longitudinal axis; (e) a second side wall supported by and substantially coupled to the center sill assembly such that the second side wall is spaced-apart from and substantially parallel to the longitudinal axis on a second side of the longitudinal axis; (f) a front outer-coil holding assembly sitting over the center sill and extending to each of the first and second side walls, wherein: (i) the front outer-coil holding assembly including first and second front coil-receiving plates, and first and second stiffeners respectively attached to the first and second front coil-receiving plates and to the first and second side walls, (ii) the front outer-coil holding assembly includes a front coil trough substantially transverse to the longitudinal axis of the center sill, and (iii) the front coil trough is substantially aligned over the front truck connection point; (g) a rear outer-coil holding assembly sitting over the center sill and extending to each of the first and second side walls, wherein: (i) the rear outer-coil holding assembly includes first and second rear coil-receiving plates, and first and second stiffeners respectively attached to the first and second front coil-receiving plates and to the first and second side walls, (ii) the rear outer-coil holding assembly includes a rear coil trough substantially transverse to the longitudinal axis of the center sill, (iii) the rear coil trough is substantially aligned over the rear truck connection point; and (h) a plurality of inner-coil holding assemblies sitting over the center sill, extending to each of the first and second side walls, and positioned between the front and rear outer-coil holding assemblies, wherein: (i) each inner-coil holding assembly including first and second inner coil-receiving plates, and first and second stiffeners respectively attached to the first and second front coil-receiving plates and to the first and second side walls, (ii) each inner coil holding assembly including an inner coil trough substantially transverse to the longitudinal axis of the center sill, and (iii) the inner coil trough of the front paired inner-coil holding assembly being substantially aligned over the center sill approximately the same distance from the front truck connection point as the inner coil trough of the back paired inner-coil holding assembly is substantially aligned over the center sill from the rear truck connection point. In various such embodiments, the stiffeners of the front outer-coil holding assembly are U-shaped stiffeners. In various such embodiments, the stiffeners of the rear outer-coil holding assembly are U-shaped stiffeners. In various such embodiments, the stiffeners of each inner outer-coil holding assembly are U-shaped stiffeners. In various such embodiments, the stiffeners of the front outer-coil holding assembly are L-shaped stiffeners. In various such embodiments, the stiffeners of the rear outer-coil holding assembly are L-shaped stiffeners. In various such embodiments, the stiffeners of the front outer-coil holding assembly are U-shaped stiffeners and L-shaped stiffeners. In various such embodiments, the stiffeners of the rear outer-coil holding assembly are U-shaped stiffeners and L-shaped stiffeners.

Figure 15:
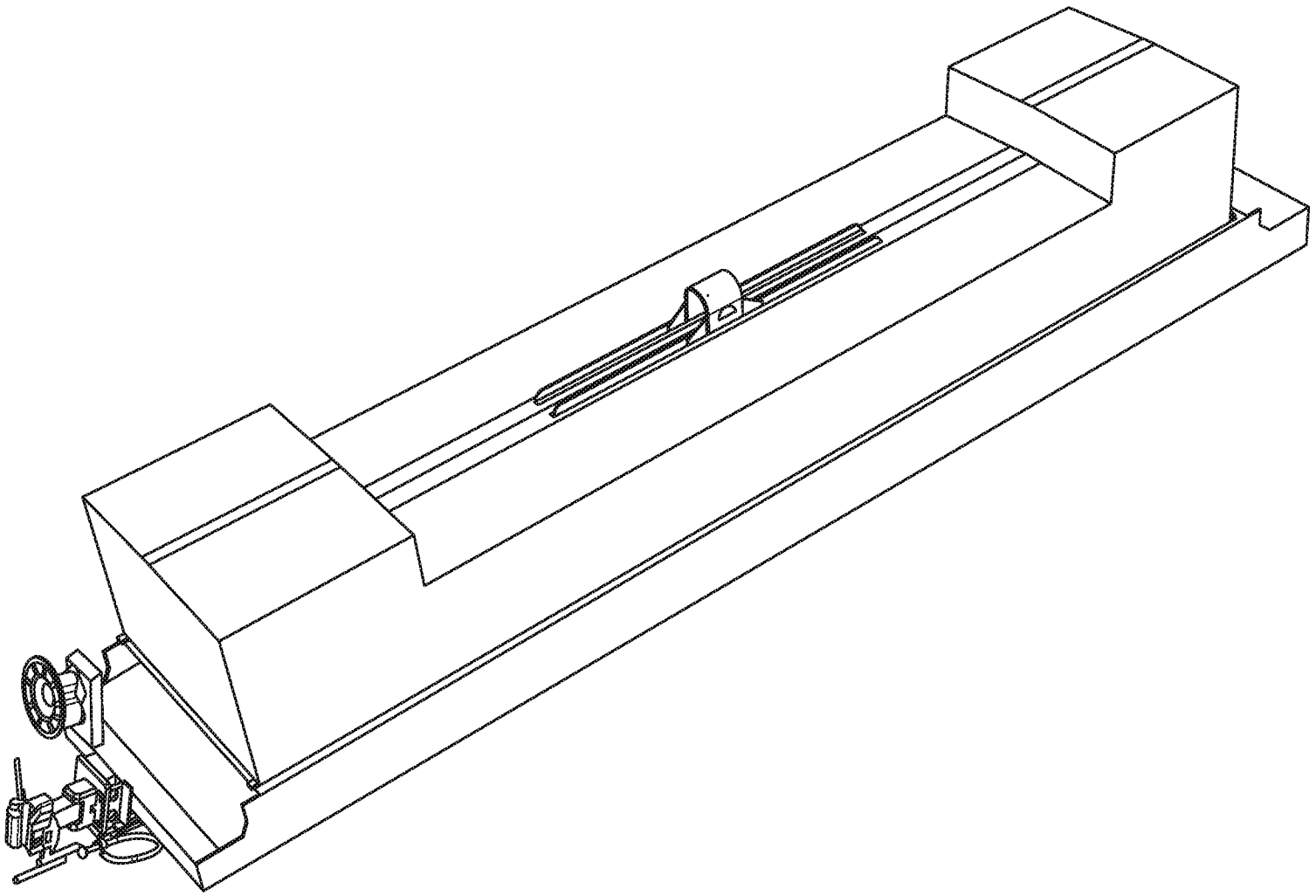
FIG. 15 of the drawings is a perspective view of one potential example embodiment of a removable roof for use with either of the example railcars illustrated in FIGS. 1 and 11.
Figure 16:
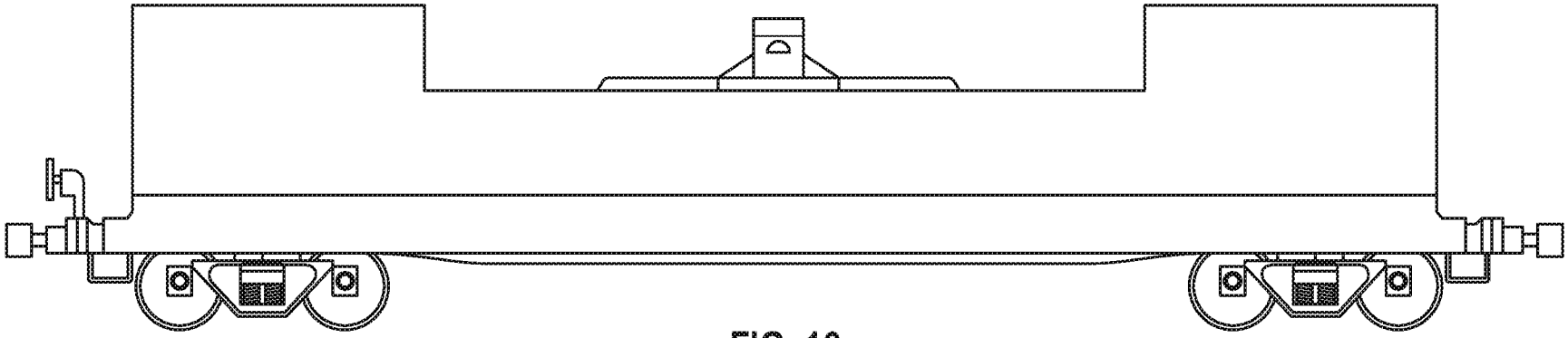
FIG. 16 of the drawings is a side elevation view of the removable roof of FIG. 15.
Figure 16A:
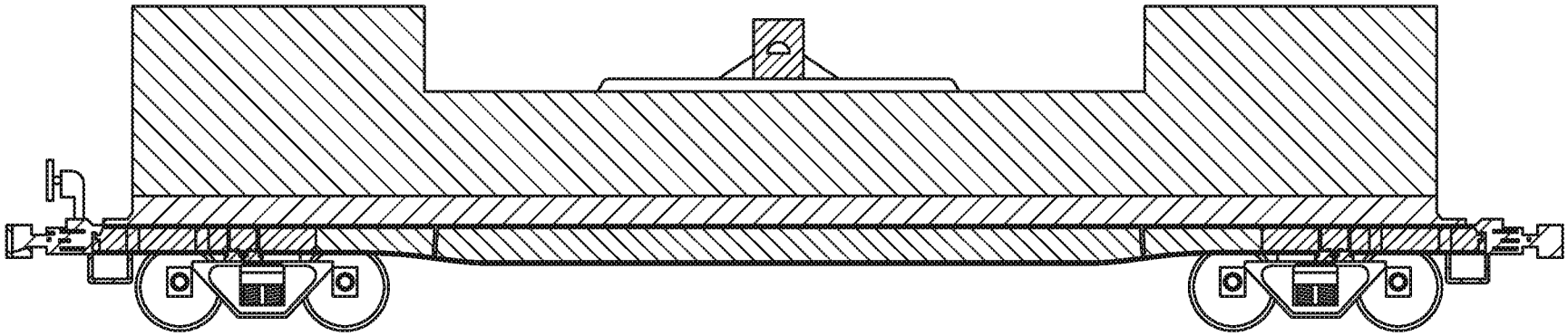
FIG. 16A of the drawings is an elevated cross-sectional view of the removable roof of FIG. 15.
Figure 17:
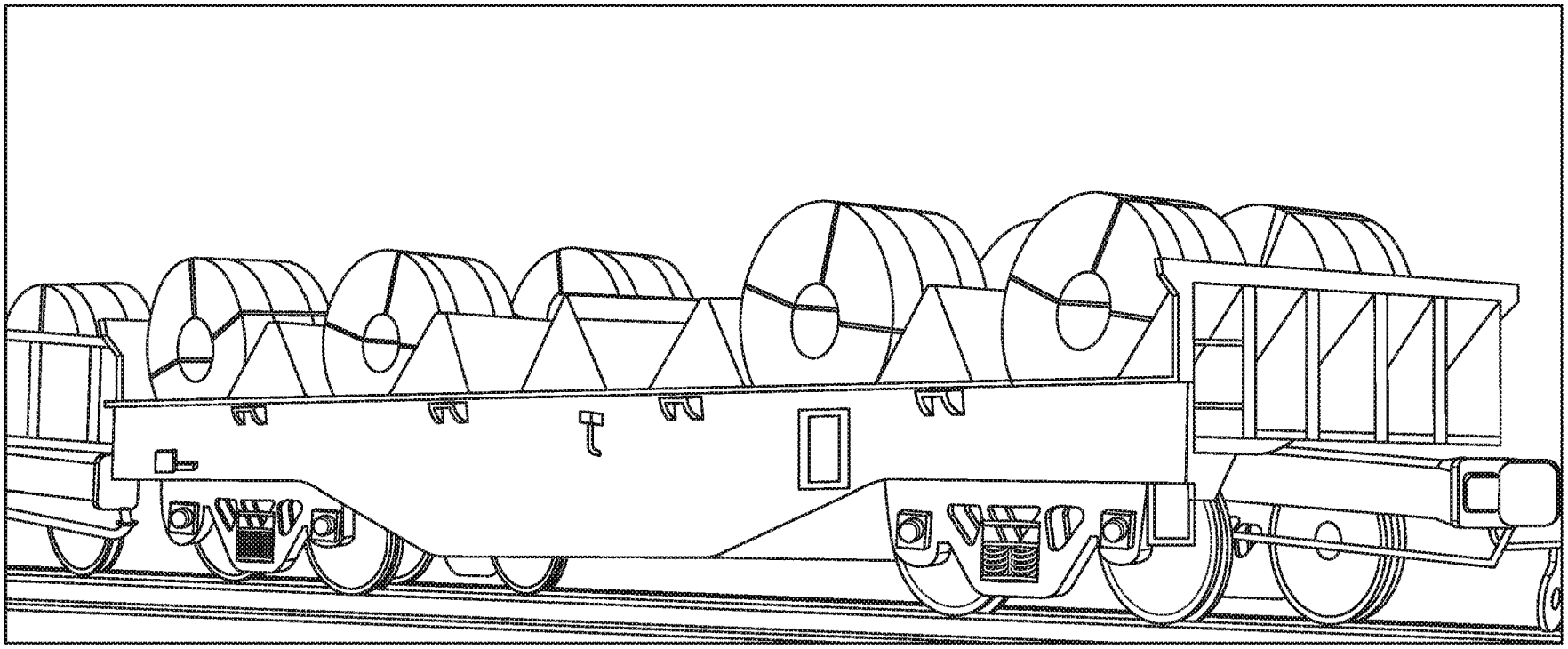
FIG. 17 (Prior Art)
FIG. 17 of the drawings illustrates a known railcar for carrying steel coils.
Figure 18:
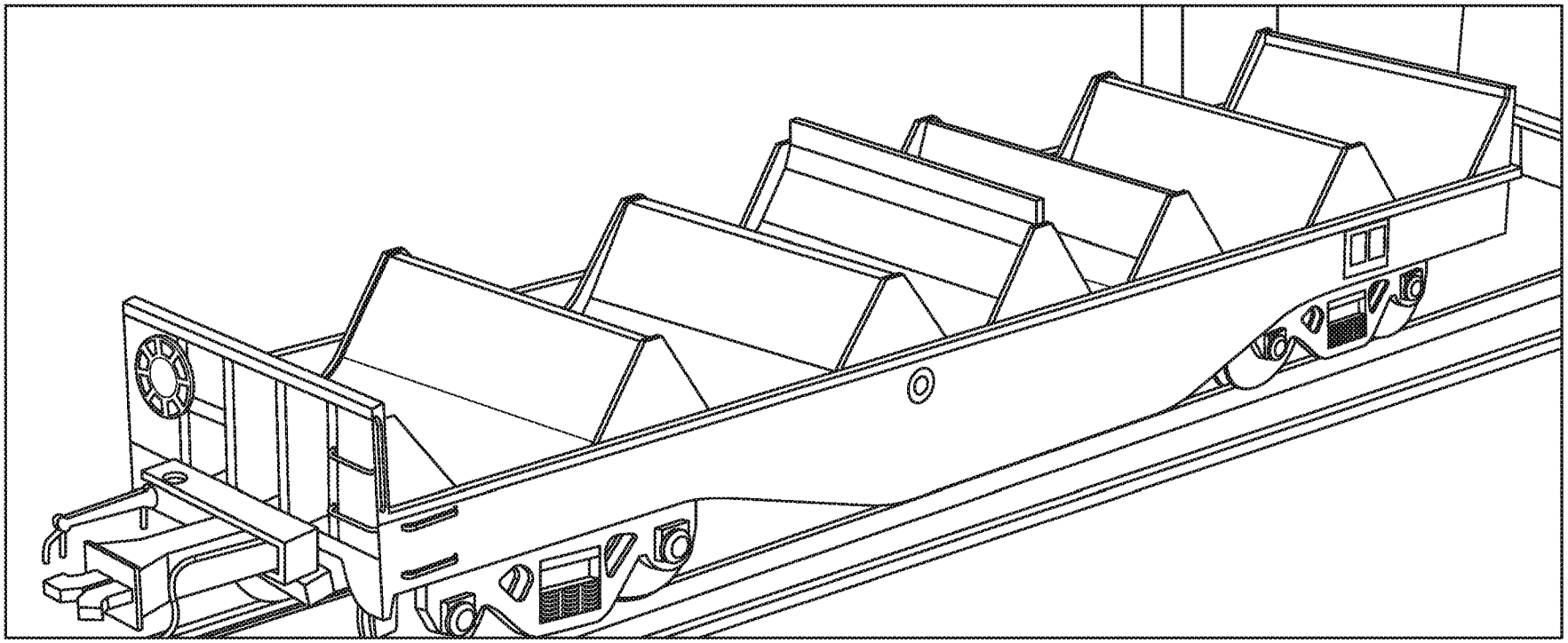
FIG. 18 (Prior Art)
FIG. 18 of the drawings illustrates another view of the known railcar of FIG. 17.
Figure 19:
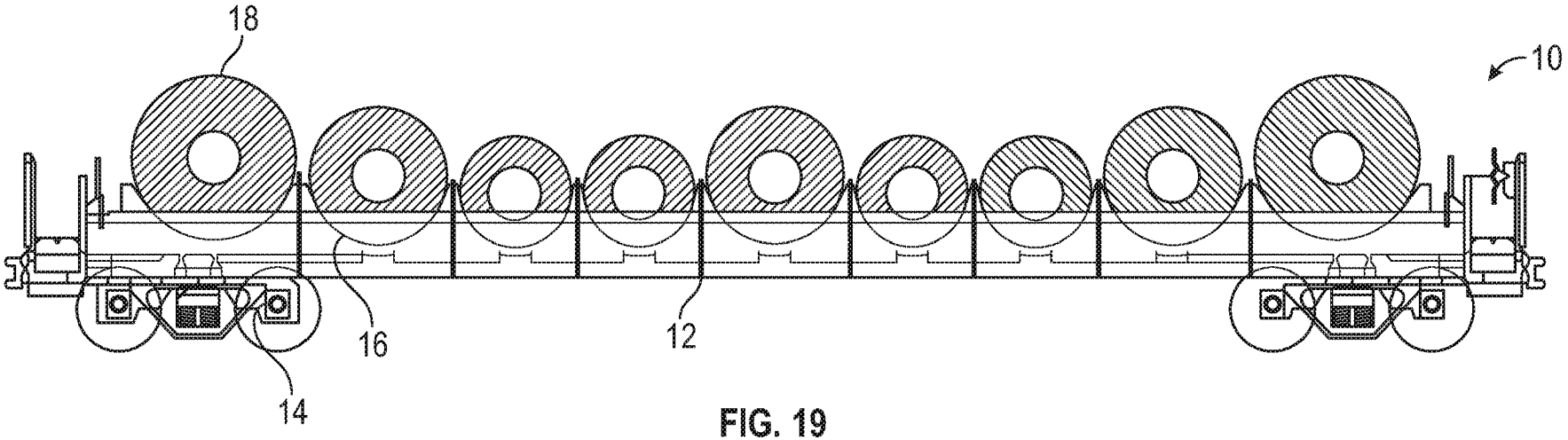
FIG. 19 (Prior Art)
FIG. 19 of the drawings illustrates another known railcar for carrying steel coils.
Figure 20:
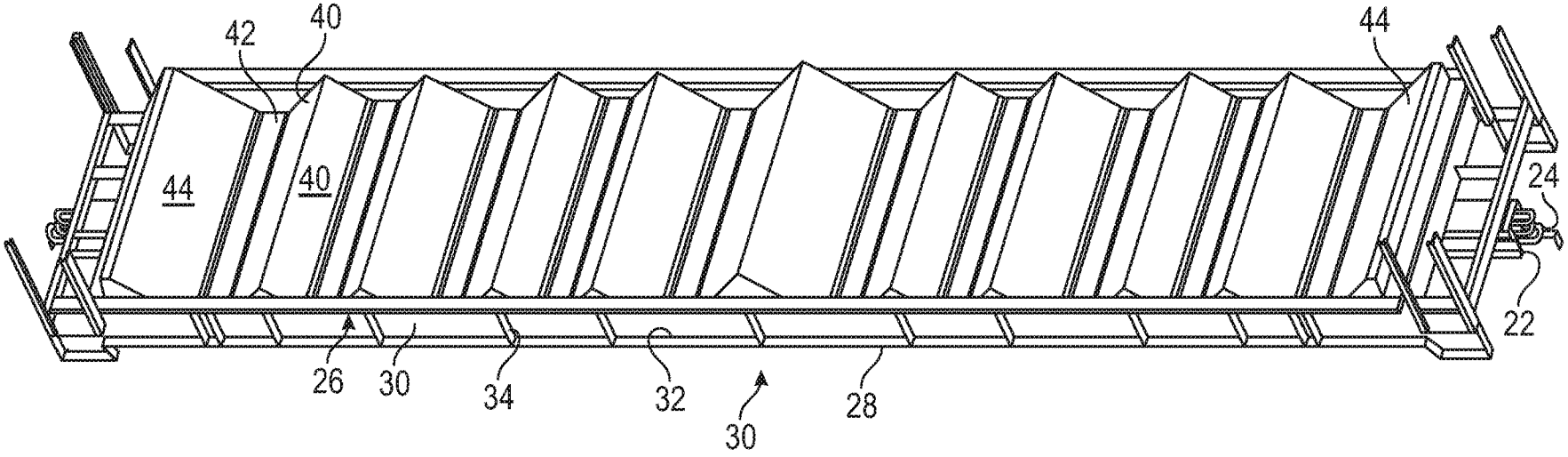
FIG. 20 (Prior Art)
FIG. 20 of the drawings illustrates another known railcar for carrying steel coils FIG. 21 of the drawings is a side cross-sectional view of the known railcar of FIG. 20.
Figure 21:
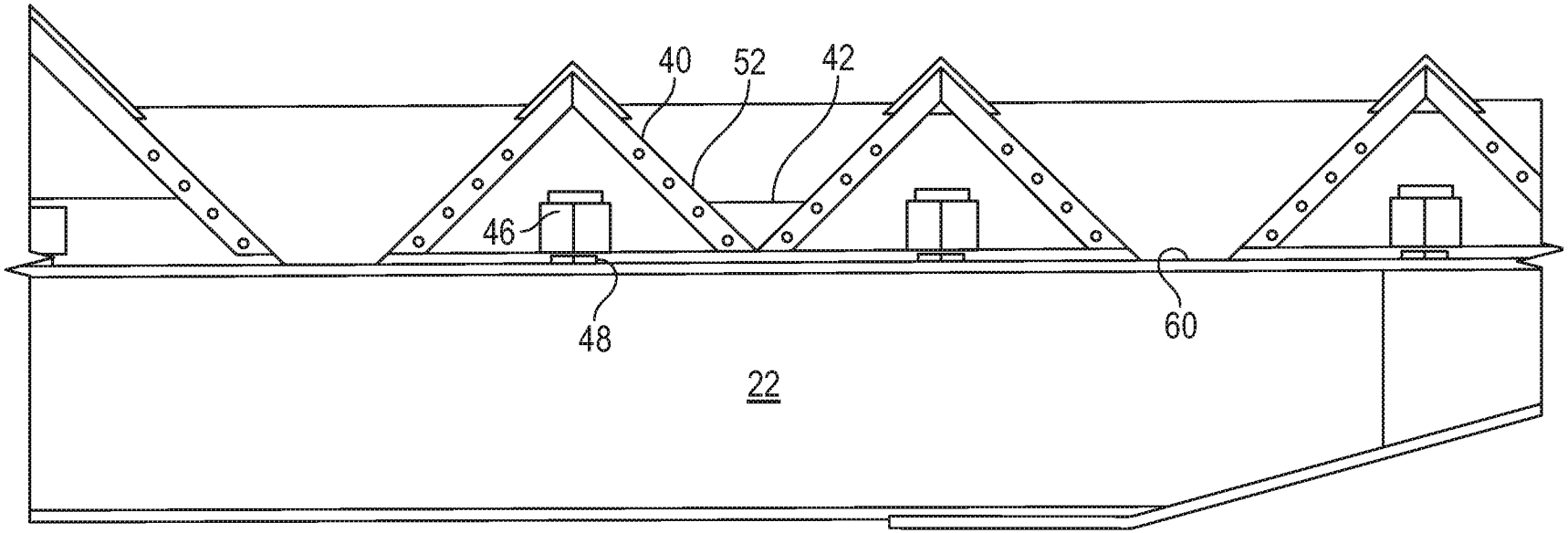
FIG. 21 (Prior Art)
Figure 22:
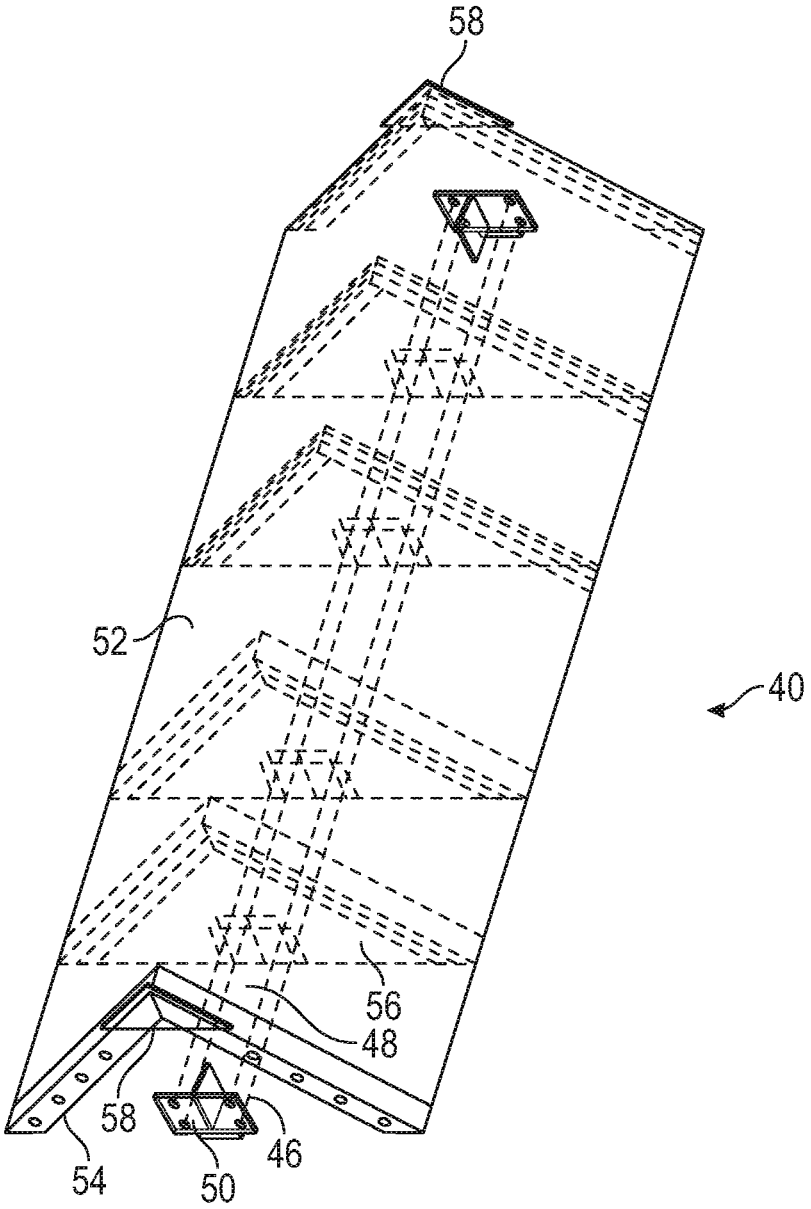
FIG. 22 (Prior Art)
FIG. 22 of the drawings is a partial cutaway, top perspective view of the bunks depicted in the known railcar illustrated in FIGS. 20 and 21.

FIG. 15 is a perspective view of one potential example embodiment of a removable roof (not labeled) for use with the example railcars illustrated in FIG. 1 or FIG. 11. FIG. 16 is a side elevation view of the same removable roof and FIG. 16A is a cross-sectional view. In this example embodiment, the roof is a multi-level roof and particularly a bi-level roof having three sections with two different heights. Collectively, these figures illustrate that railcar 100 may be used with a removable roof. The removable roof circumscribes a roof void such that when the removable roof is positioned on top of the first and second side walls, steel coils held in the holding assemblies fit within the roof void. The roof void also preferably has a layer of insulation (not shown or labeled) about its periphery to keep the heat from cooling steel coils from dissipating too quickly. As shown in the figures, the removable roof preferably has two different heights including two spaced apart sections (not labeled) with taller heights positioned over the respective spaced apart outer-coil holding assemblies and a section (not labeled) having a lower height positioned between the two sections having the taller heights. One advantage of this roof is that the lower roof point makes it easier for a simple forklift to remove the roof from the remainder of the railcar 100. It should be appreciated that the roof may be alternatively configured in accordance with the present disclosure.

The foregoing description and drawings merely explain and illustrate the present disclosure and the present disclosure is not limited thereto. While the specification is described in relation to certain implementations or embodiments, many details are set forth for the purpose of illustration. Thus, the foregoing merely illustrates the principles of the present disclosure. For example, the present disclosure may have other specific forms without departing from its spirit or essential characteristics. The described arrangements are illustrative and not restrictive. To those skilled in the art, the present disclosure is susceptible to additional implementations or embodiments and certain details described in this application may be varied considerably without departing from the basic principles of the present disclosure. It will thus be appreciated that those skilled in the art will be able to devise various arrangements which, although not explicitly described or shown herein, embody the principles of the present disclosure and, thus, within its scope and spirit.

What is claimed is:

1. A railcar for transporting one or more steel coils, each steel coil having a coil diameter, the railcar comprising:

(a) a front truck assembly including at least one pair of front truck wheels, an axle coupled to each pair of front truck wheels, and a front truck connection point positioned to distribute a load placed on the front truck assembly substantially evenly;

(b) a rear truck assembly including at least one pair of rear truck wheels, an axle coupled to each pair of rear truck wheels, and a rear truck connection point positioned to distribute a load placed on the rear truck assembly substantially evenly;

(c) a center sill assembly operably supported at the front truck connection point by the front truck assembly and at a rear truck connection point by the rear truck assembly, the center sill having a longitudinal axis;

(d) a first side wall supported by and substantially coupled to the center sill assembly such that the first side wall is spaced-apart from and substantially parallel to the longitudinal axis on a first side of the longitudinal axis;

(e) a second side wall supported by and substantially coupled to the center sill assembly such that the second side wall is spaced-apart from and substantially parallel to the longitudinal axis on a second side of the longitudinal axis;

(f) a front outer-coil holding assembly sitting over the center sill and extending to each of the first and second side walls, wherein:

(i) the front outer-coil holding assembly includes first and second front coil-receiving plates respectively attached to the first and second side walls, and first and second stiffeners respectively attached to the first and second front coil-receiving plates and to the first and second side walls, (ii) the front outer-coil holding assembly includes a front coil trough substantially transverse to the longitudinal axis of the center sill, and (iii) the front coil trough is substantially aligned over the front truck connection point;

(g) a rear outer-coil holding assembly sitting over the center sill and extending to each of the first and second side walls, wherein:

(i) the rear outer-coil holding assembly includes first and second rear coil-receiving plates respectively attached to the first and second side walls, and first and second stiffeners respectively attached to the first and second front coil-receiving plates and to the first and second side walls, (ii) the rear outer-coil holding assembly includes a rear coil trough substantially transverse to the longitudinal axis of the center sill, (iii) the rear coil trough is substantially aligned over the rear truck connection point;

(h) a plurality of inner-coil holding assemblies sitting over the center sill, extending to each of the first and second side walls, and positioned between the front and rear outer-coil holding assemblies, wherein:

(i) each inner-coil holding assembly including first and second inner coil-receiving plates respectively attached to the first and second side walls, and first and second stiffeners respectively attached to the first and second front coil-receiving plates and to the first and second side walls, (ii) each inner coil holding assembly including an inner coil trough substantially transverse to the longitudinal axis of the center sill, and (iii) the inner coil trough of the front paired inner-coil holding assembly being substantially aligned over the center sill approximately the same distance from the front truck connection point as the inner coil trough of the back paired inner-coil holding assembly is substantially aligned over the center sill from the rear truck connection point;

(i) a single removable roof positionable on the first and second side walls, the removable roof including a first section having a first height, a second section having a second height, and a third section having a third height, wherein the second section is between the first section and the third section, wherein the second height is less than the first height and the second height is less than the third height, wherein the first section is positionable over the front outer-coil holding assembly, the third section is positionable over the rear outer-coil holding assembly, and the second section is positionable over the plurality of inner-coil holding assemblies, and wherein the removeable roof includes a lifting member attached to and extending upwardly from the second section.

2. The railcar of claim 1, wherein the stiffeners of the front outer-coil holding assembly are U-shaped stiffeners.

3. The railcar of claim 2, wherein the stiffeners of the rear outer-coil holding assembly are U-shaped stiffeners.

4. The railcar of claim 3, wherein the stiffeners of an inner outer-coil holding assembly are U-shaped stiffeners.

5. The railcar of claim 1, wherein the stiffeners of the front outer-coil holding assembly are L-shaped stiffeners.

6. The railcar of claim 5, wherein the stiffeners of the rear outer-coil holding assembly are L-shaped stiffeners.

7. The railcar of claim 1, wherein the stiffeners of the front outer-coil holding assembly are U-shaped stiffeners and L-shaped stiffeners.

8. The railcar of claim 1, wherein the stiffeners of the rear outer-coil holding assembly are U-shaped stiffeners and L-shaped stiffeners.

9. A railcar for transporting one or more steel coils, each steel coil having a coil diameter, the railcar comprising:

(a) a front truck assembly including at least one pair of front truck wheels, and an axle coupled to each pair of front truck wheels;

(b) a rear truck assembly including at least one pair of rear truck wheels, and an axle coupled to each pair of rear truck wheels;

(c) a center sill assembly operably supported by the front truck assembly and by the rear truck assembly, the center sill having a longitudinal axis;

(d) a first side wall supported by and substantially coupled to the center sill assembly such that the first side wall is spaced-apart from and substantially parallel to the longitudinal axis on a first side of the longitudinal axis;

(e) a second side wall supported by and substantially coupled to the center sill assembly such that the second side wall is spaced-apart from and substantially parallel to the longitudinal axis on a second side of the longitudinal axis;

(f) a plurality of coil holding assemblies sitting over the center sill and extending to each of the first and second side walls, wherein each coil holding assembly includes:

a first coil-receiving plate and a second coil-receiving plate that partially define a coil trough substantially transverse to the longitudinal axis of the center sill, a first stiffener extending across and substantially coupled to an outer face of the first coil-receiving plate, the first stiffener being substantially coupled to both the first and second side walls, and a second stiffener extending across and substantially coupled to an outer face of the second coil-receiving plate, the second stiffener being substantially coupled to both the first and second side walls; and (g) a single removable roof positionable on the first and second side walls, the removable roof including a first section having a first height, a second section having a second height, and a third section having a third height, wherein the second section is between the first section and the third section, wherein the second height is less than the first height and the second height is less than the third height, wherein the first section is positionable over one of the coil holding assemblies at a first end of the railcar, the second section is positionable over at least one of the coil holding assemblies, and the third section is positionable over one of the inner-coil holding assemblies at a second end of the railcar, and wherein the removeable roof includes a lifting member attached to and extending upwardly from the second section.

10. The railcar of claim 9, wherein for at least one of the plurality of coil holding assemblies, the first stiffener is U-shaped and the second stiffener is U-shaped.

11. The railcar of claim 10, wherein for one of the plurality of coil holding assemblies, the first stiffener is L-shaped and the second stiffener is L-shaped.

12. The railcar of claim 9, wherein for at least one of the plurality of coil holding assemblies, the first stiffener is L-shaped and the second stiffener is L-shaped.

13. The railcar of claim 9, wherein at least one of the plurality of coil holding assemblies includes an anti-deformation plate transversely extending to the stiffeners.

14. The railcar of claim 13, wherein the anti-deformation plate extends over the center sill.

15. The railcar of claim 9, wherein each of the plurality of coil holding assemblies includes an anti-deformation plate transversely extending to the stiffeners.

16. The railcar of claim 15, wherein each of the anti-deformation plates extends over the center sill.

17. A railcar for transporting one or more steel coils, each steel coil having a coil diameter, the railcar comprising:

(a) a front truck assembly including at least one pair of front truck wheels, and an axle coupled to each pair of front truck wheels;

(b) a rear truck assembly including at least one pair of rear truck wheels, and an axle coupled to each pair of rear truck wheels;

(c) a center sill assembly operably supported by the front truck assembly and by the rear truck assembly, the center sill having a longitudinal axis;

(d) a first side wall supported by and substantially coupled to the center sill assembly such that the first side wall is spaced-apart from and substantially parallel to the longitudinal axis on a first side of the longitudinal axis;

(e) a second side wall supported by and substantially coupled to the center sill assembly such that the second side wall is spaced-apart from and substantially parallel to the longitudinal axis on a second side of the longitudinal axis;

(f) a plurality of coil holding assemblies sitting over the center sill and extending to each of the first and second side walls, wherein each coil holding assembly includes a first coil-receiving plate and a second coil-receiving plate that partially define a coil trough substantially transverse to the longitudinal axis of the center sill, and an anti-deformation plate extending under the first coil-receiving plate and the second coil-receiving plate and extending over the center silk; and (g) a single removable roof positionable on the first and second side walls, the removable roof including a first section having a first height, a second section having a second height, and a third section having a third height, wherein the second section is between the first section and the third section, wherein the second height is less than the first height and the second height is less than the third height, wherein the first section is positionable over one of the coil holding assemblies at a first end of the railcar, the second section is positionable over at least one of the coil holding assemblies, and the third section is positionable over one of the inner-coil holding assemblies at a second end of the railcar, and wherein the removeable roof includes a lifting member attached to and extending upwardly from the second section.

18. The railcar of claim 17, wherein each of the plurality of coil holding assemblies includes a first stiffener extending across and substantially coupled to an outer face of the first coil-receiving plate, the first stiffener being substantially coupled to both the first and second side walls, and a second stiffener extending across and substantially coupled to an outer face of the second coil-receiving plate, the second stiffener being substantially coupled to both the first and second side walls.

19. A railcar for transporting one or more steel coils, each steel coil having a coil diameter, the railcar comprising:

(a) a front truck assembly including at least one pair of front truck wheels, and an axle coupled to each pair of front truck wheels;

(b) a rear truck assembly including at least one pair of rear truck wheels, and an axle coupled to each pair of rear truck wheels;

(c) a center sill assembly operably supported by the front truck assembly and by the rear truck assembly, the center sill having a longitudinal axis;

(d) a first side wall supported by and substantially coupled to the center sill assembly such that the first side wall is spaced-apart from and substantially parallel to the longitudinal axis on a first side of the longitudinal axis;

(e) a second side wall supported by and substantially coupled to the center sill assembly such that the second side wall is spaced-apart from and substantially parallel to the longitudinal axis on a second side of the longitudinal axis;

(f) a plurality of coil holding assemblies sitting over the center sill and extending to each of the first and second side walls, wherein each coil holding assembly includes a first coil-receiving plate and a second coil-receiving plate that partially define a coil trough substantially transverse to the longitudinal axis of the center sill, the first coil-receiving plate including a first bottom foot extending toward the second coil-receiving plate, the second front coil-receiving plate including a second bottom foot extending toward the first coil-receiving plate, the first bottom foot being longer than the second bottom foot, and the first bottom foot and the second bottom foot being attached in an overlapping configuration; and (g) a single removable roof positionable on the first and second side walls, the removable roof including a first section having a first height, a second section having a second height, and a third section having a third height, wherein the second section is between the first section and the third section, wherein the second height is less than the first height and the second height is less than the third height, wherein the first section is positionable over one of the coil holding assemblies at a first end of the railcar, the second section is positionable over at least one of the coil holding assemblies, and the third section is positionable over one of the inner-coil holding assemblies at a second end of the railcar, and wherein the removeable roof includes a lifting member attached to and extending upwardly from the second section.

20. The railcar of claim 19, wherein the longer first bottom foot is overlapped by the shorter second bottom foot.

21. The railcar of claim 20, wherein the shorter second bottom foot is welded to the longer first bottom foot.

22. A railcar for transporting one or more steel coils, each steel coil having a coil diameter, the railcar comprising:

(a) a front truck assembly including at least one pair of front truck wheels, an axle coupled to each pair of front truck wheels, and a front truck connection point positioned to distribute a load placed on the front truck assembly substantially evenly;

(b) a rear truck assembly including at least one pair of rear truck wheels, an axle coupled to each pair of rear truck wheels, and a rear truck connection point positioned to distribute a load placed on the rear truck assembly substantially evenly;

(c) a center sill assembly operably supported at the front truck connection point by the front truck assembly and at a rear truck connection point by the rear truck assembly, the center sill having a longitudinal axis;

(d) a first side wall supported by and substantially coupled to the center sill assembly such that the first side wall is spaced-apart from and substantially parallel to the longitudinal axis on a first side of the longitudinal axis;

(e) a second side wall supported by and substantially coupled to the center sill assembly such that the second side wall is spaced-apart from and substantially parallel to the longitudinal axis on a second side of the longitudinal axis;

(f) a front outer-coil holding assembly sitting over the center sill and extending to each of the first and second side walls, wherein:

(i) the front outer-coil holding assembly includes first and second front coil-receiving plates, each of the first and second front coil-receiving plates having an inner face and an outer face wherein the inner and outer faces are bounded by a lower edge and at least two side edges, the lower edge of the first front coil-receiving plate being substantially coupled to one of the inner or outer faces of the second front coil-receiving plate, and the lower edge of the second front coil-receiving plate being substantially coupled to the opposite of the inner or outer faces of the first front coil-receiving plate, (ii) the front outer-coil holding assembly includes a front coil trough substantially transverse to the longitudinal axis of the center sill, the front coil trough being substantially flat and positioned about at least one of the lower edges of the front coil-receiving plates, (iii) the first front coil-receiving plate is articulated, beyond the front coil trough, generally away from the center sill, (iv) the second front coil-receiving plate is articulated, beyond the front coil trough, as a spaced-apart, substantially mirror image of the first front coil-receiving plate such that the first and second front coil-receiving plates have space to accommodate between their respective inner faces a steel coil having as much as a large coil diameter, (v) each of the first and second front coil-receiving plates is substantially coupled to each of the first and second side walls, (vi) the front outer-coil holding assembly includes stiffeners extending across and substantially coupled to the outer face of each of the first and second front coil-receiving plates, each stiffener further being substantially coupled to both the first and second side walls, and (vii) the front coil trough is substantially aligned over the front truck connection point;

(g) a rear outer-coil holding assembly sitting over the center sill and extending to each of the first and second side walls, wherein:

(i) the rear outer-coil holding assembly includes first and second rear coil-receiving plates, each of the first and second rear coil-receiving plates having an inner face and an outer face wherein the inner and outer faces are bounded by a lower edge and at least two side edges, the lower edge of the first rear coil-receiving plate being substantially coupled to one of the inner or outer faces of the second rear coil-receiving plate, and the lower edge of the second rear coil-receiving plate being substantially coupled to the opposite of the inner or outer faces of the first rear coil-receiving plate, (ii) the rear outer-coil holding assembly includes a rear coil trough substantially transverse to the longitudinal axis of the center sill, the rear coil trough being substantially flat and positioned about at least one of the lower edges of the rear coil-receiving plates, (iii) the first rear coil-receiving plate is articulated, beyond the rear coil trough, generally away from the center sill, (iv) the second rear coil-receiving plate is articulated, beyond the rear coil trough, as a spaced-apart, substantially mirror image of the first rear coil-receiving plate such that the first and second rear coil-receiving plates have space between their respective inner faces to accommodate a steel coil having as much as a large coil diameter, (v) each of the first and second rear coil-receiving plates being substantially coupled to each of the first and second side walls, (vi) the rear outer-coil holding assembly includes stiffeners extending across and substantially coupled to the outer face of each of the first and second rear coil-receiving plates, each stiffener further being substantially coupled to both the first and second side walls, and (vii) the rear coil trough is substantially aligned over the rear truck connection point;

(h) a paired plurality of inner-coil holding assemblies sitting over the center sill, extending to each of the first and second side walls, and positioned between the front and rear outer-coil holding assemblies, wherein:

(i) each of the front paired and back paired inner-coil holding assemblies includes first and second inner coil-receiving plates, each of the first and second inner coil-receiving plates having an inner face and an outer face wherein the inner and outer faces are bounded by a lower edge and at least two side edges, the lower edge of the first inner coil-receiving plate being substantially coupled to one of the inner or outer faces of the second inner coil-receiving plate and the lower edge of the second inner coil-receiving plate being substantially coupled to the opposite of the inner or outer faces of the first inner coil-receiving plate, (ii) each inner outer-coil holding assembly including an inner coil trough substantially transverse to the longitudinal axis of the center sill, the inner coil trough being substantially flat and positioned about at least one of the lower edges of the inner coil-receiving plates, (iii) the first inner coil-receiving plate is articulated, beyond the inner coil trough, generally away from the center sill, (iv) the second inner coil-receiving plate is articulated, beyond the inner coil trough, as a spaced-apart, substantially mirror image of the first inner coil-receiving plate such that the first and second inner coil-receiving plates have space to accommodate between the respective inner faces of the first and second inner coil-receiving plates a steel coil having as much as a medium coil diameter, (v) each of the first and second inner coil-receiving plates being substantially coupled to each of the first and second side walls, (vi) each inner outer-coil holding assembly including stiffeners extending across and substantially coupled to the outer face of each of the first and second inner coil-receiving plates, each stiffener further being substantially coupled to both the first and second side walls, and (vii) the inner coil trough of the front paired inner-coil holding assembly being substantially aligned over the center sill approximately the same distance from the front truck connection point as the inner coil trough of the back paired inner-coil holding assembly is substantially aligned over the center sill from the rear truck connection point; and (i) a single removable roof positionable on the first and second side walls, the removable roof including a first section having a first height, a second section having a second height, and a third section having a third height, wherein the second section is between the first section and the third section, wherein the second height is less than the first height and the second height is less than the third height, wherein the first section is positionable over the front outer-coil holding assembly, the third section is positionable over the rear outer-coil holding assembly, and the second section is positionable over the plurality of inner-coil holding assemblies, and wherein the removeable roof includes a lifting member attached to and extending upwardly from the second section.

23. The railcar of claim 22 wherein each of the stiffeners has a longitudinal axis, and which includes at least one anti-deformation plate inserted transversely to the longitudinal axis of at least one of the stiffeners.

24. The railcar of claim 22, which includes multiple pairs of inner coil holding assemblies.

* * * * *